US008381563B2

(12) United States Patent
De Souza et al.

(10) Patent No.: US 8,381,563 B2
(45) Date of Patent: Feb. 26, 2013

(54) FORGING DIE HEATING APPARATUSES AND METHODS FOR USE

(75) Inventors: Urban J. De Souza, Charlotte, NC (US); Robin M. Forbes-Jones, Charlotte, NC (US); Billy B. Hendrick, Marshville, NC (US); Alonzo L. Liles, Locust, NC (US); Ramesh S. Minisandram, Charlotte, NC (US); Sterry A. Shaffer, Matthews, NC (US)

(73) Assignee: ATI Properties, Inc., Albany, OR (US)

( * ) Notice: Subject to any disclaimer, the term of this patent is extended or adjusted under 35 U.S.C. 154(b) by 820 days.

(21) Appl. No.: 12/480,246

(22) Filed: Jun. 8, 2009

(65) Prior Publication Data

US 2010/0307216 A1 Dec. 9, 2010

(51) Int. Cl.
*B21D 37/16* (2006.01)

(52) U.S. Cl. ..... 72/342.7; 72/342.8; 72/364

(58) Field of Classification Search ..... 72/38, 60, 72/342.1, 342.4, 342.5, 342.7, 342.8, 364
See application file for complete search history.

(56) References Cited

U.S. PATENT DOCUMENTS

| | | | | | |
|---|---|---|---|---|---|
| 2,615,509 | A | * | 10/1952 | Whittington | 239/427.3 |
| 2,737,224 | A | * | 3/1956 | Jones | 72/38 |
| 2,752,982 | A | * | 7/1956 | Lalli | 72/296 |
| 3,302,439 | A | | 2/1967 | Chattin et al. | |
| 3,440,858 | A | | 4/1969 | Motley et al. | |
| 3,489,134 | A | * | 1/1970 | Cowan | 126/91 A |
| 3,698,219 | A | * | 10/1972 | Moore et al. | 72/38 |
| 3,783,669 | A | | 1/1974 | Furney, Jr. | |
| 4,088,000 | A | | 5/1978 | Tomioka et al. | |
| 4,444,039 | A | | 4/1984 | Asari et al. | |
| 4,534,196 | A | * | 8/1985 | Kiyoto et al. | 72/61 |
| 4,549,866 | A | | 10/1985 | Granville | |
| 4,736,608 | A | | 4/1988 | Laws et al. | |
| 4,756,685 | A | | 7/1988 | Davies et al. | |
| 4,788,842 | A | | 12/1988 | Kopp et al. | |
| 4,996,863 | A | | 3/1991 | Keeler | |
| 5,405,082 | A | | 4/1995 | Brown et al. | |
| 5,515,705 | A | | 5/1996 | Weldon et al. | |
| 5,553,474 | A | * | 9/1996 | Nokajima et al. | 72/60 |

(Continued)

FOREIGN PATENT DOCUMENTS

JP 60-158940 A 8/1985

OTHER PUBLICATIONS

"Oxy-Fuel Combustion Process," printed on Nov. 14, 2008 from http://en.wikipedia.org/wiki/Oxy-fuel_combustion_process, 1 page.

(Continued)

*Primary Examiner* — Edward Tolan
(74) *Attorney, Agent, or Firm* — K & L Gates LLP; Patrick J. Viccaro; John E. Grosselin, III

(57) ABSTRACT

A forging die heating or preheating apparatus comprises a burner head comprising a plurality of flame ports. The burner head is oriented to compliment an orientation of at least a region of a forging surface of a forging die and is configured to receive and combust a supply of an oxidizing gas and a supply of a fuel and produce flames at the flame ports. The plurality of flame ports are configured to impinge the flames onto the forging surface of the forging die to substantially uniformly heat at least the region of the forging surface of the forging die.

18 Claims, 21 Drawing Sheets

U.S. PATENT DOCUMENTS

| | | | | |
|---|---|---|---|---|
| 5,688,339 | A | 11/1997 | Farmer et al. | |
| 6,044,685 | A | 4/2000 | Delgado et al. | |
| 6,857,868 | B1 * | 2/2005 | Li et al. | 431/266 |
| 7,254,978 | B2 * | 8/2007 | Bergue et al. | 72/342.8 |
| 7,895,999 | B2 * | 3/2011 | Graham et al. | 126/215 |

OTHER PUBLICATIONS

"Oxy-Fuel Combustion," *R&D Facts*, Aug. 2008, 2 pages.

Blue, C.A., et al. "Infrared Heating of Forging Billets and Dies", pp. 1-15, Nov. 1999.

Sirrine, Mark M. "Flame Impingement Is Versatile, Reliable Heating Technique," *Industrial Heating*, www.industrialheating.com, Apr. 2004, pp. 1-3.

"FIA: Forging Facts—How are Forgings Produced?" printed on Nov. 14, 2008 from http://www.forging.org/facts/wwhy6.htm, pp. 1-6.

Bulk Gases, Oxyfuel Solutions for Heating and Melting, printed on Nov. 14, 2008 from http://www.airgas.com/content/details.aspx?id=7000000000311, 1 page.

"Open Die Forging, Machine Forging (upsetter forging), Mandrel Forging, Match, Microalloye . . . " printed on Nov. 14, 2008 from http://www.qcforge.com/defin4.html, pp. 1-3.

"The Open Die Forging Process," printed on Nov. 14, 2008 from http://www.scotforge.com/sf_facts_opendie.htm, pp. 1-2.

"Oxy-Fuel Combustion Process," printed on. Nov. 14, 2008 from http://en.wikipedia.org/wiki/Oxy-fuel_combustion_process, 1 page.

* cited by examiner

FORGING DIE HEATING APPARATUSES AND METHODS FOR USE

BACKGROUND OF THE TECHNOLOGY

1. Field of the Technology

The present disclosure relates to equipment and techniques for forging die heating. The present disclosure more specifically relates to equipment and techniques for heating a forging surface of a forging die.

2. Description of the Background of the Technology

A work piece, such as an ingot or a billet, for example, can be forged into a particular configuration or shape using a forging die. Forging dies can comprise open-faced forging dies, closed-faced or "impression" forging dies, or other suitable forging dies. Most open-faced forging dies can comprise a first or a top portion and a second or a bottom portion. In general, the bottom portion can act as an "anvil" or a stationary portion, while the top portion can act as the "hammer" or a movable portion as it moves toward and away from the bottom portion. In other open-faced forging dies, both the top and the bottom portions can move toward each other or, in still other configurations, the bottom portion can move toward a stationary top portion, for example. The movement of the top or bottom portions of the forging die can be accomplished through the use of pneumatic actuators or hydraulic actuators, for example. In any event, the top and bottom portions of the forging die can be disposed in an open position, where they are spaced a suitable distance from each other, and in a closed position, where they contact or nearly contact each other.

During the forging process, a portion of the work piece can be positioned between the top portion and the bottom portion of the forging die and forged by force applied by the top portion and/or the bottom portion. Applying such force to the work piece can change the structural properties and/or the crystalline structure of the work piece, such as through work hardening, thereby possibly developing weak spots in the work piece. Work hardening, for example, may be inhibited if the work piece is heated to a suitable temperature prior to or during the forging process. Heating of the work piece can make the work piece more malleable such that it can be forged using less force applied by the top and/or the bottom portions of the forging die. Depending on the composition of the work piece, the work piece can be heated to a temperature in the range of 1800-2100 degrees Fahrenheit, for example, prior to being forged, to facilitate forging of the work piece. As can be seen, various benefits may be achieved by heating the work piece prior to and/or during forging.

In addition to the heating of the work piece prior to and/or during forging, in some instances, the top and/or bottom portions of the forging die can also be heated to reduce or minimize any temperature differential between the heated work piece and the top and bottom portions of the forging die. Through such heating, surface cracking of the work piece during forging can be reduced relative to forging using a forging die at ambient temperature (20-25 degrees Celsius). For example, if a region of a work piece heated to a temperature of 1800-2100 degrees Fahrenheit contacts a forging die at ambient temperature, the significant temperature differential reduces the temperature of the work piece region and adjacent regions. The significant temperature differential can create mechanically weak regions within the work piece that may make the work piece unsuitable for its intended application. Further, in some instances, the significant temperature differential between forging die and work piece can lead to inclusions in the work piece caused by non-uniform cooling of the work piece during and after forging if the region of the work piece contacted by the ambient temperature forging die cools faster than the rest of the heated work piece.

In an attempt to minimize these negative consequences, referring to FIG. 1, certain forging techniques employ a single torch 2 aimed at a forging die 4 to preheat much or all of the forging die 4 prior to forging a work piece (not illustrated). This single torch 2 can be a natural gas or a propane air-aspirated torch, for example. Because a single torch 2 is used, this forging die preheating technique can take several hours or longer and may only heat the forging die 4 to a temperature in the range of 600-800 degrees Fahrenheit, for example. In most instances, the forging die 4 is heated with the top portion 6 and the bottom portion 8 of the forging die 4 in a closed, or substantially closed, position. As such, the single torch 2 can be moved vertically about a side surface 9 of the top and bottom portions 6 and 8 of the forging die 4 in the directions indicated by arrow "A" and arrow "B", for example, to heat the forging die 4. Also, the single torch 2 can be moved horizontally about the side surface 9 of the top and bottom portions 6 and 8 of the forging die 4 in the directions indicated by arrow "C" and arrow "D", to heat the forging die 4. In other embodiments, the single torch 2 can be moved both horizontally and vertically about the side surface 9. Of course, the single torch 2 can also be moved about the side surface 9 of the forging die 4 in any other suitable direction or can remain stationary.

Such preheating of the forging die, although helpful in the forging process, can lead to non-uniform heating of the forging die 4 or a forging surface 5 of the forging die 4, again possibly resulting in inclusions or weak spots in the work piece where the forging die 4 contacts and cools the work piece. Another issue with the above-described preheating practice is that, even though the forging die 4 can be heated to about 600-800 degrees Fahrenheit, there can still be a substantial temperature differential between the work piece, which may be at forging temperatures of about 1800-2100 degrees Fahrenheit, and the forging die 4. The existence of a significant temperature differential between the work piece and the forging surface 5 can sometimes lead to surface cracking of crack-sensitive alloy work pieces, such as Alloy 720, Rene '88, and Waspaloy, for example. Further, the non-uniform cooling produced by temperature differentials can, in some instances, cause inclusions or weak spots within work pieces of these alloys.

Given the drawbacks associated with conventional forging die pre-heating techniques, it would be advantageous to develop alternative pre-heating techniques.

SUMMARY OF THE TECHNOLOGY

According to one non-limiting aspect of the present disclosure, an embodiment of a forging die heating apparatus comprises a burner head comprising a plurality of flame ports. The burner head is oriented to compliment an orientation of at least a region of a forging surface of a forging die. The burner head is configured to receive and combust a supply of an oxidizing gas and a supply of a fuel and produce flames at the flame ports. The plurality of flame ports are configured to impinge the flames onto at least a region of the forging surface of the forging die to substantially uniformly heat at least a region of the forging surface of the forging die.

According to another non-limiting aspect of the present disclosure, an embodiment of a forging die heating apparatus comprises a burner head comprising a plurality of flame ports. The burner head is configured to be at least partially conformed to an orientation of a region of a forging surface of a forging die. The burner head is configured to receive and combust a supply of an oxidizing gas and a supply of a fuel and produce flames at the flame ports. The plurality of flame ports are configured to impinge the flames onto and substantially uniformly heat the region of the forging surface of the forging die.

According to yet another non-limiting aspect of the present disclosure, an embodiment of an open-faced forging die heating apparatus comprises a burner comprising a manifold configured to receive a supply of an oxidizing gas and a supply of fuel and a burner head. The burner head comprises a first portion comprising a first set of flame ports comprising at least two flame ports. The first set of flame ports are in fluid communication with the manifold such that the first set of flame ports are configured to impinge at least two flames onto a first region of a forging surface of a forging die. The burner head further comprises a second portion comprising a second set of flame ports comprising at least two flame ports. The second set of flame ports are in fluid communication with the manifold such that the second set of flame ports are configured to impinge at least two flames onto a second region of the forging surface of the forging die, wherein an orientation of the burner head conforms to an orientation of at least the first region of the forging surface of the forging die.

According to still another non-limiting aspect of the present disclosure, an embodiment of a forging die preheating apparatus comprises a burner head comprising a first flame port, a second flame port, and a third flame port. The second flame port is substantially the same distance from the first flame port and the third flame port. The burner head is configured to receive and combust a supply of an oxidizing gas and a supply of fuel to produce a flame at each of the first flame port, the second flame port, and the third flame port. Each of the first flame port, the second flame port, and the third flame port are configured to impinge the flames onto at least a region of a forging surface of a forging die and preheat the region of the forging surface prior to forging a work piece with the forging die.

According to still another non-limiting aspect of the present disclosure, an embodiment of a method of heating a forging die comprises positioning a burner head comprising at least two flame ports in proximity to a region of a forging surface of the forging die. The method further comprises supplying an oxy-fuel to the at least two flame ports and combusting the oxy-fuel at the at least two flame ports to produce an oxy-fuel flame at each of the at least two flame ports. The method further comprises impinging at least two of the oxy-fuel flames onto the region of the forging surface of the forging die and substantially uniformly heating the region of the forging surface of the forging die.

According to still another non-limiting aspect of the present disclosure, an embodiment of a method of preheating an open-faced forging die comprises positioning a burner head comprising at least two flame ports in a location at least partially intermediate a first forging surface of the forging die and a second forging surface of the forging die. The burner head is oriented to at least partially conform to an orientation of at least one of the first forging surface and the second forging surface. The method further comprises supplying a fuel to the at least two flame ports, combusting the fuel to produce a flame at each of the at least two flame ports, and impinging at least two of the flames onto at least one of the first forging surface and the second forging surface.

According to yet another non-limiting aspect of the present disclosure, an embodiment of a forging die drift hard-stop system for a forging die apparatus including a top forging portion attached to a cross head and a bottom forging portion is provided. The forging die drift hard-stop system comprises an arm comprising a first end and a second end. The second end of the arm is pivotably attached to a portion of the forging die apparatus and a spacer is attached to the first end of the arm. The arm is movable between a first position, where the spacer is free from engagement with a portion of the forging die apparatus and a portion of the cross head, and a second position, where the spacer is engaged with the portion of the forging die apparatus and the portion of the cross head to inhibit movement of the top forging portion toward the bottom forging portion.

According to still another non-limiting aspect of the present disclosure, an embodiment of a forging die heating apparatus is provided. The forging die heating apparatus comprises an arm and a burner head movably attached to the arm. The burner head is configured to be moved between a first position relative to the arm and a second position relative to the arm. The forging die heating apparatus further comprises a plurality of burner nozzles positioned on the burner head and at least one assembly in fluid communication with the plurality of burner nozzles. The at least one assembly comprises an air aspirator configured to allow air to enter the burner head and an orifice configured to allow a combustible fuel to flow therethrough.

BRIEF DESCRIPTION OF THE DRAWINGS

Features and advantages of the apparatus and methods described herein may be better understood by reference to the accompanying drawings in which.

Figure 1:
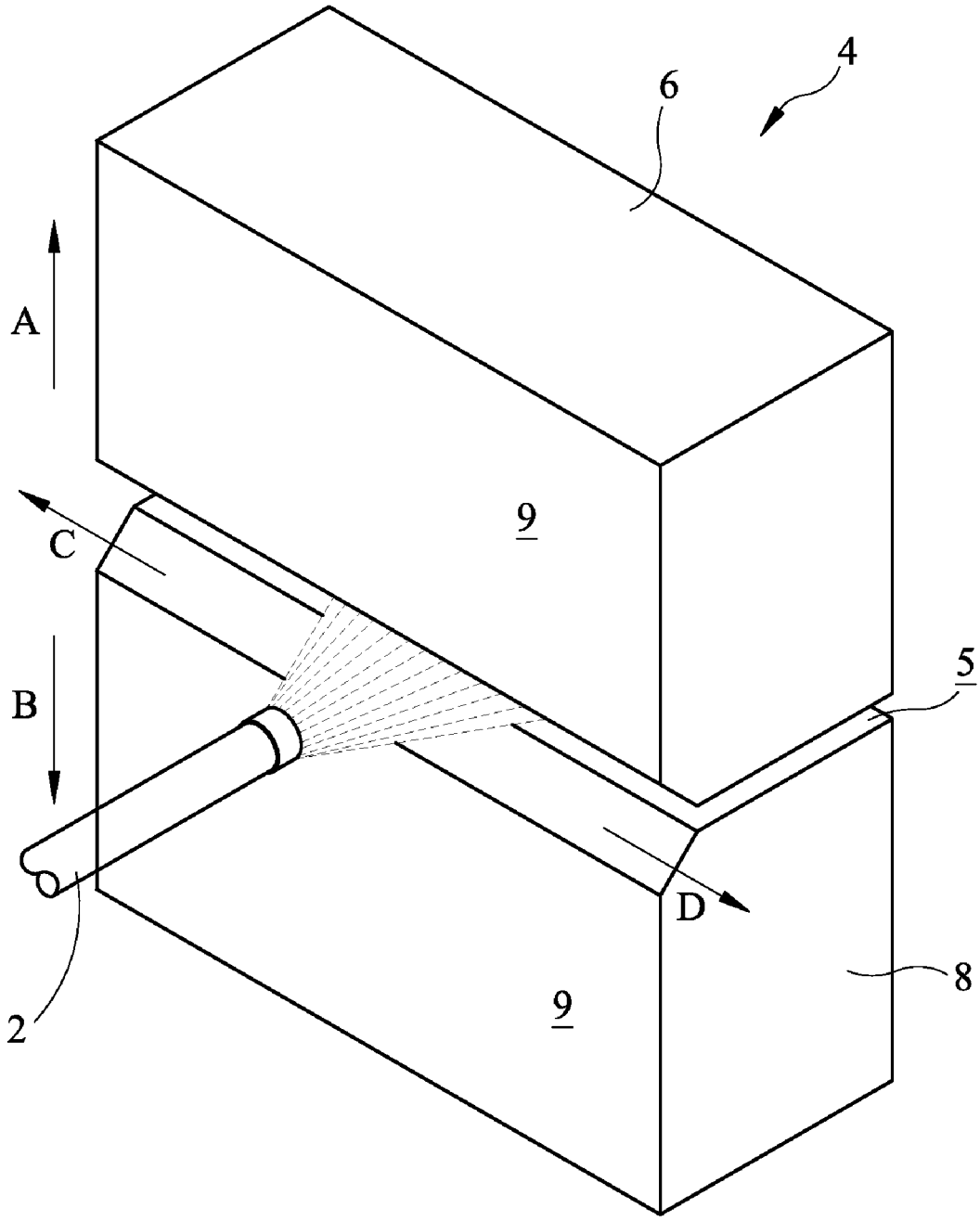
FIG. 1 is a schematic illustration of a conventional forging die heating process.

The reader will appreciate the foregoing details, as well as others, upon considering the following detailed description of certain non-limiting embodiments of apparatuses and methods according to the present disclosure. The reader also may comprehend certain of such additional details upon carrying out or using the apparatuses and methods described herein.

DETAILED DESCRIPTION OF CERTAIN NON-LIMITING EMBODIMENTS

In the present description of non-limiting embodiments, other than in the operating examples or where otherwise indicated, all numbers expressing quantities or characteristics of elements, ingredients and products, processing conditions, and the like are to be understood as being modified in all instances by the term "about". Accordingly, unless indicated to the contrary, any numerical parameters set forth in the following description are approximations that may vary depending upon the desired properties one seeks to obtain in the apparatuses and methods according to the present disclosure. At the very least, and not as an attempt to limit the application of the doctrine of equivalents to the scope of the claims, each numerical parameter should at least be construed in light of the number of reported significant digits and by applying ordinary rounding techniques.

The present disclosure, in part, is directed to improved designs for forging die heating apparatuses configured to heat a forging die or all or a region of a forging surface of a forging die. In one non-limiting embodiment, referring to FIG. 2, a forging die 10 can comprise a top portion 12 and a bottom portion 14. The top portion 12 of the forging die 10 can be movable with respect to the bottom portion 14 of the forging die 10 or vice versa, for example. In one non-limiting embodiment, this movement can be accomplished through the use of pneumatic and/or hydraulic actuators. In other non-limiting embodiments, the top portion 12 and the bottom portion 14 can both be movable relative to each other. In certain non-limiting embodiments, the top portion 12 can act as the "hammer" and the bottom portion 14 can act as the "anvil" such that at least a portion of a work piece (not illustrated) can be positioned intermediate the top portion 12 and the bottom portion 14 during forging of the work piece. The forging can take place owing to significant force applied to at least a portion of the work piece by the top portion 12 and/or the bottom portion 14 of the forging die 10. The top portion 12 can comprise a first forging surface 16 and the bottom portion 14 can comprise a second forging surface 18. The first and second forging surfaces 16 and 18 are generally brought into contact with regions of the work piece during forging to forge the work piece into a desired shape and/or to have a desired dimension. In various non-limiting embodiments, the forging die 10 can be an open-faced forging die, for example. In other non-limiting embodiments, the forging die can be a closed or "impression" forging die, or can have any other suitable forging die design.

Prior to forging, it may be desirable to heat or preheat (hereinafter the terms "preheat" or "preheating" will also encompass the terms "heat" or "heating", and vice versa) all or a region of the first forging surface 16 and/or the second forging surface 18 of the forging die 10. Such heating can reduce a temperature differential between a heated work piece and the first and/or the second forging surfaces 16 and 18. Convention preheating techniques using a single torch, however, can require hours to heat a forging die given that the techniques involve preheating only a small area of a side surface of the forging die at any one time. Using such convention preheating techniques can also result in non-uniform heating of the first and second forging surfaces 16 and 18. As a result, when the forging surfaces 16 and 18 contact the work piece, a first region of the forging surfaces 16 and 18 may be a first temperature and a second region of the forging surfaces 16 and 18 may be a substantially different second temperature, thereby possibly resulting in surface cracking and/or non-uniform cooling of the work piece, for example. Further, such conventional preheating techniques may not preheat the first and/or second forging surfaces 16 and 18 to a temperature substantially the same as the heated work piece, thereby allowing a significant temperature differential to exist between the work piece and/or the first and second forging surfaces 16 and 18 of the forging die 10. If a significant temperature differential exists, the portion of the work piece contacting the forging surfaces 16 and 18 may be cooled too quickly, which can lead to surface cracking and/or inclusions within the work piece, for example.

Figure 2:
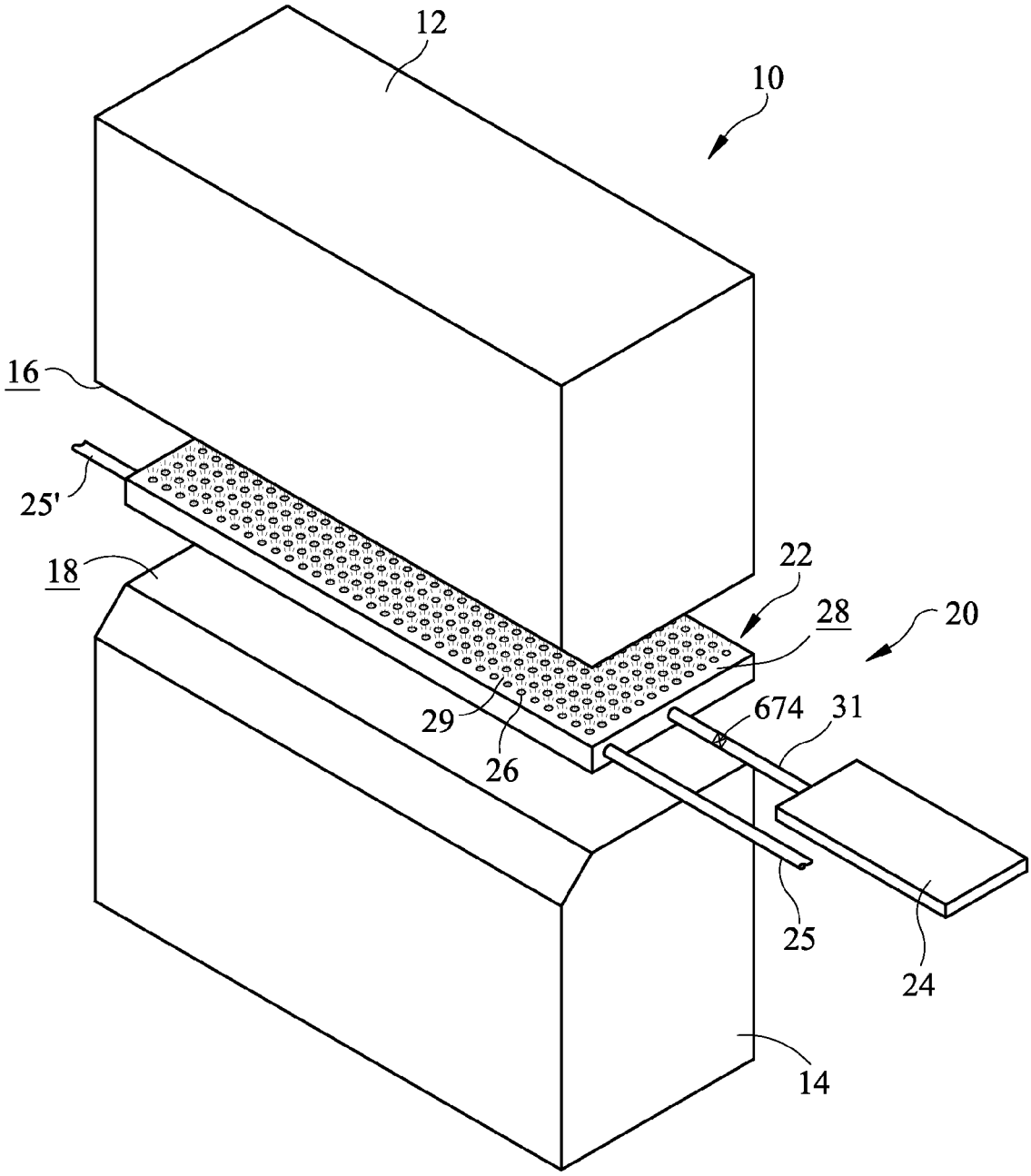
FIG. 2 is a simplified depiction of certain components of one non-limiting embodiment of a forging die heating apparatus according to the present disclosure.
Figure 3:
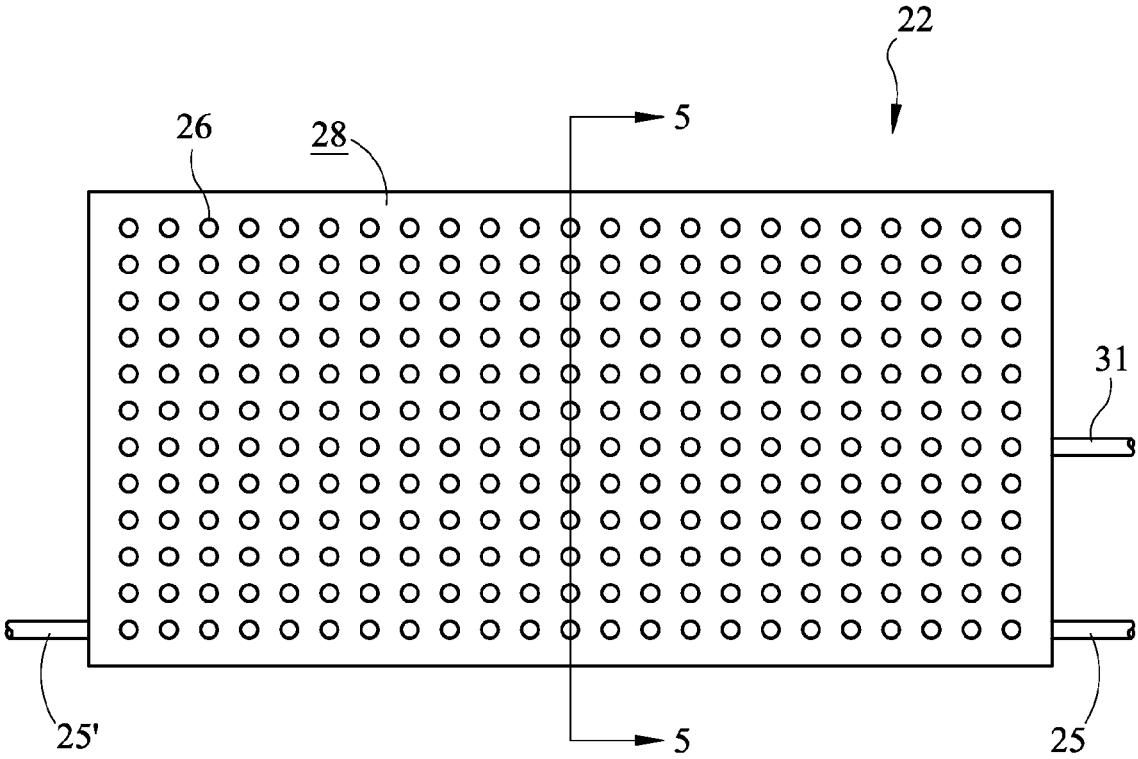
FIG. 3 is a top view of certain components of the forging die heating apparatus illustrated in FIG. 2.
Figure 4:
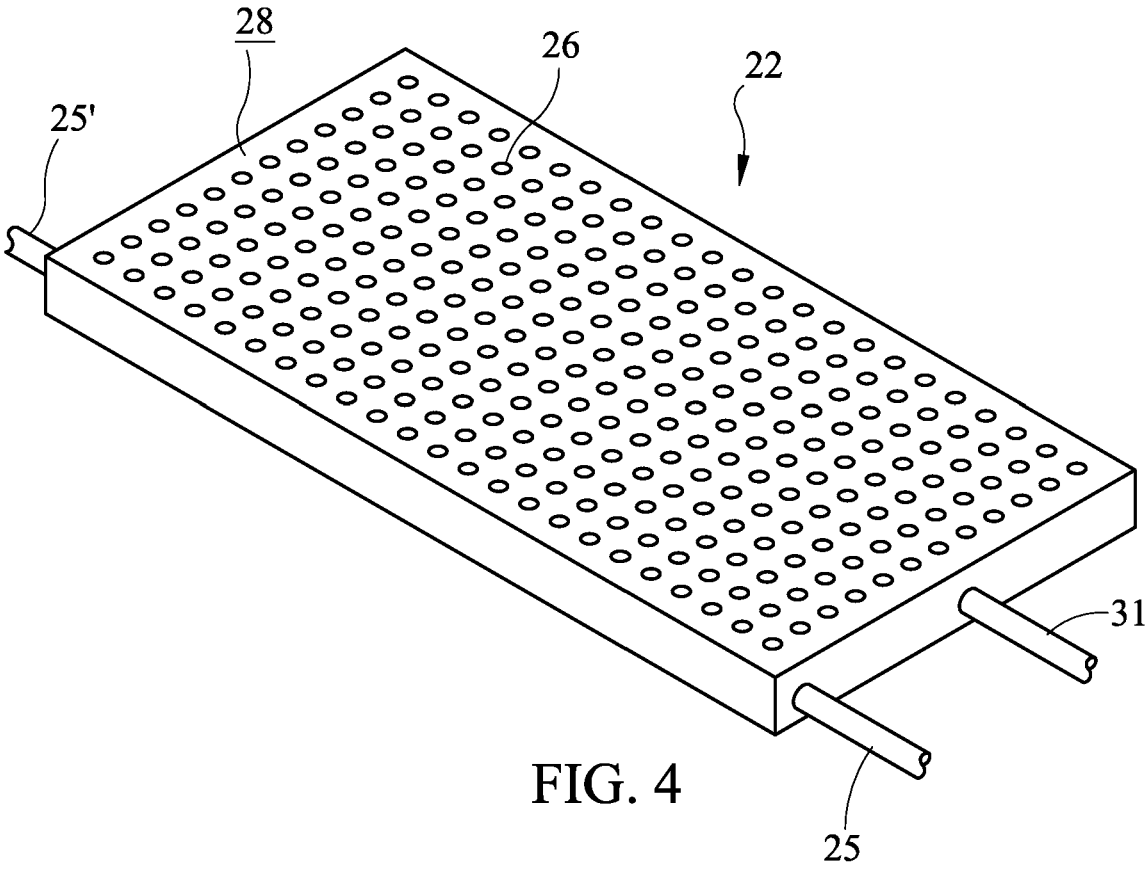
FIG. 4 is a perspective view of certain components of the forging die heating apparatus illustrated in FIG. 3.

To provide uniform, or substantially uniform, preheating of at least a region of the first and/or the second forging surfaces 16 and 18, an improved forging die heating apparatus 20 is provided. Hereinafter the terms "forging surface" or "forging surfaces" may comprise regions of both the top and bottom portions of the various forging dies. As shown in FIG. 2, the forging die heating apparatus 20 can be configured to be positioned at least partially intermediate the top and bottom portions 12 and 14 of the forging die 10. As such, the forging die heating apparatus 20 can be configured to be positioned at least partially intermediate and opposing the first forging surface 16 and the second forging surface 18 of the forging die 10. In one non-limiting embodiment, the forging die heating apparatus 20 can be positioned proximate to at least one of the first forging surface 16 and the second forging surface 18 such that it can impinge two or more flames onto at least a region of at least one of the forging surfaces 16 and 18 of the forging die 10 to preheat the forging surfaces 16 and/or 18 prior to forging a work piece with the forging die 10.

In one non-limiting embodiment, aspects of which are schematically illustrated in FIGS. 2-5C, the forging die heating apparatus 20 can comprise a burner or a burner head 22 configured to be in fluid communication with a supply of an oxidizing gas and a supply of a fuel. The burner head 22 can be comprised of brass or any other suitable thermally conductive metal or material, such as copper, for example, that can withstand the high temperatures generated by the burner head 22. In various non-limiting embodiments, the burner head 22 can comprise any suitable shape, orientation, and/or dimensions configured to conform the burner head 22 to an orientation of a forging surface of a forging die or region of the forging surface. As used herein, "conform" can mean to configure to an orientation of a forging surface, or a region of a forging surface, of a forging die, to place in proximity to, or close proximity to, a forging surface, or a region of a forging surface, of a forging die, and/or to orient to compliment a forging surface, or a region of a forging surface, of a forging die.

In one non-limiting embodiment, the burner head 22 can be in fluid communication with one or more mixing devices or torches 24 configured to receive the supply of the oxidizing gas and the supply of the fuel and provide a mixed supply of the oxidizing gas and the fuel to the burner head 22 via conduit 31. Although oxidizing gas and fuel supply lines are not illustrated in FIG. 2, it will be understood that the various mixing torches discussed herein are in fluid communication with a supply of an oxidizing gas and a supply of a fuel. In one non-limiting embodiment, the mixing torch 24, although illustrated as having a rectangular shape herein, can comprise any suitable configuration and/or shape. Additionally, although a mixing torch is not illustrated and described with respect to each non-limiting embodiment of the forging die heating apparatuses described herein, it will be apparent from the disclosure that a mixing torch can be used with each non-limiting embodiment of the present disclosure or other various embodiments requiring the mixing of a fuel and an oxidizing gas to provide a mixed supply of the fuel and the oxidizing gas to a burner head included in the forging die heating apparatuses.

In one non-limiting embodiment, referring to FIG. 2, the burner head 22 can be cooled using a liquid, such as water, for example, or other liquid, vapor, and/or gas having sufficient heat transfer or absorption capabilities. This cooling may be provided to prevent or at least inhibit melting of the burner head 22, or portions of the burner head 22, during heating of the forging surfaces 16 and 18 of the forging die 10. The liquid can be supplied to the burner head 22 through line 25 and can exit the burner head 22 through another line 25' or through a portion of the line 25, for example. In such a non-limiting embodiment, the liquid can be passed through one or more passages or channels in the burner head 22 to cool the burner head 22 or portions thereof. In one non-limiting embodiment, lines 25 and 25' can be rigid such that they can be used to move the burner head 22 into and out of a position at least partially intermediate the top portion 12 and the bottom portion 14 of the forging die 10.

In one non-limiting embodiment, the burner head 22 can be comprised of a highly heat conductive material, such as brass or copper, for example. The burner head 22 can also comprise one or more mixing chambers or manifolds (referred to collectively as "manifold") configured to receive a mixed supply of a fuel, such as natural gas, methane, and/or propane, for example, and an oxidizing gas, such as air or pure oxygen, for example. The one or more manifolds can be in fluid communication with various flame ports 26 of the burner head 22 such that the mixed supply can be provided to the flame ports 26 and combusted at the flame ports 26. At least one passage or channel, configured to receive a cooling liquid, vapor, and/or gas can at least partially surround, be positioned adjacent to, and/or be positioned proximate to, the one or more manifolds. Of course, the hottest portion of the burner head 22 is usually the portion of the burner head 22 comprising the flame ports 26. One object of the cooling system is to extract any excessive heat in the walls of the one or more manifolds and/or the walls of the flame ports 26 to prevent, inhibit, or at least minimize the chance of, internal explosions and/or combustion within the one or more manifolds of the burner head 22 owing to the heat within the burner head 22. In some circumstances, these internal explosions and/or combustion can cause the burner head 22 to operate in inefficiently. Thus, by providing distinct manifolds and passages or channels for the fuel and oxidizing gas mixture and the liquid, respectively, along with the highly heat conductive materials of the burner head 22, heat can easily be dissipated from the walls of the one or more manifolds and/or the walls of the flame ports 26.

Figure 5A:
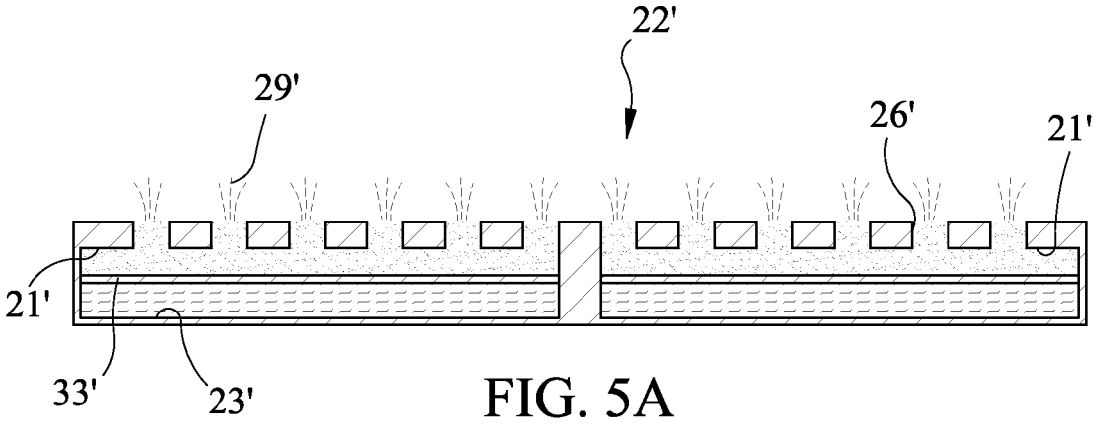
FIG. 5A is a cross-section view taken along line 5-5 and in the direction of the arrows in FIG. 3, illustrating certain components of the forging die heating apparatus of FIG. 2, according to one embodiment of the present disclosure.
Figure 5B:
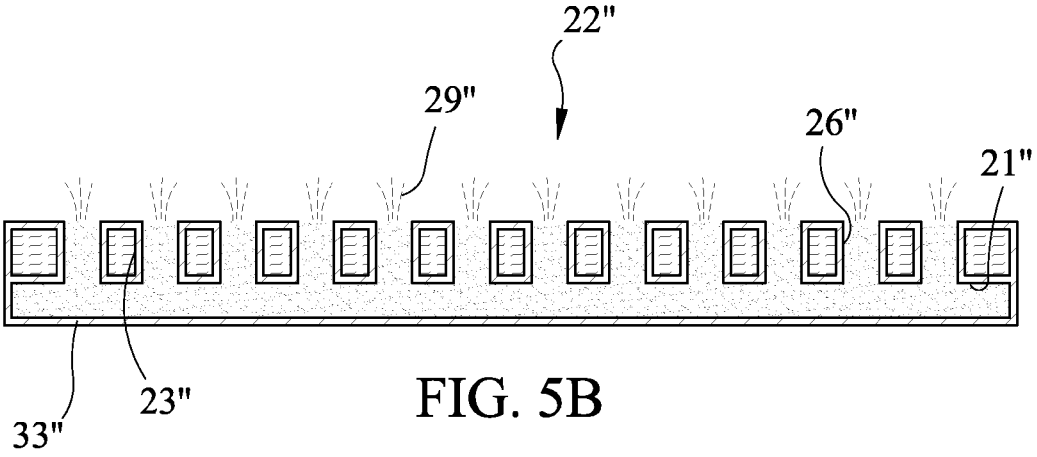
FIG. 5B is a cross-section view taken along line 5-5 and in the direction of the arrows in FIG. 3, illustrating certain components of the forging die heating apparatus of FIG. 2, according to one embodiment of the present disclosure.
Figure 5C:
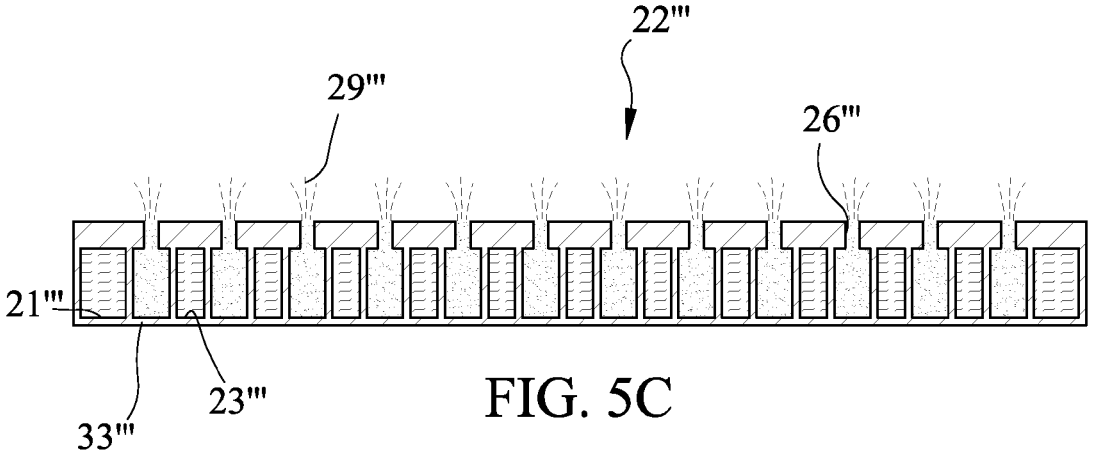
FIG. 5C is a cross-section view taken along line 5-5 and in the direction of the arrows in FIG. 3, illustrating certain components of the forging die heating apparatus of FIG. 2, according to one embodiment of the present disclosure.

In non-limiting exemplary embodiments, the above-referenced cooling system is illustrated in FIGS. 5A-5C. FIGS. 5A-5C are exemplary cross-sectional views of the burner head 22 taken along line 5-5 of FIG. 3. Referring to FIG. 5A, the burner head 22' can comprise one or more manifolds 21' in fluid communication with various flame ports 26' such that the mixed supply of the fuel and the oxidizing gas can be supplied to the flame ports 26' for combustion. The burner head 22' can also comprise at least one passage 23' or channel positioned to cool the walls 33' of the one or more manifolds 21' and/or the walls of the flame ports 26' when a liquid, such as water, for example, is flowed through the passage 23'. In one non-limiting embodiment, the one or more manifolds 21' can be separated by walls formed of the same highly conductive material as the burner head 22'. As such, the cooling system can allow at least a portion of the heat within the walls 33 and/or the walls of the flame ports 26' to be transferred to the water or other liquid, vapor, and/or gas within the passage 23' and removed from the burner head 22' to maintain the burner head 22' at a cool temperature relative to the temperature of flames 29'. Referring now to FIG. 5B, a burner head 22" can comprise one or more manifolds 21" in fluid communication with various flame ports 26". The burner head 22" can also comprise a plurality of passages 23" or channels at least partially surrounding portions of the walls 33" of the one or more manifolds 21" and/or walls of the flame ports 26". As such, at least a portion of the heat within the walls 33" and/or the walls of the flame ports 26 can be transferred to the liquid and removed from the burner head 22" by the flowing liquid to maintain the burner head 22" at a cool temperature relative to the temperature of flames 29". Referring to FIG. 5C, burner head 22''' can comprise a plurality of manifolds 21''' each in fluid communication with at least one flame port 26'''. The burner head 22''' can also comprise a plurality of passages 23''' or channels at least partially surrounding portions of the walls 33''' of the manifold 21''' and/or walls of the flame ports 26'''. In one non-limiting embodiment, the manifolds 21''' and the passages 23''' can be positioned in an alternating pattern across the burner head 22''' such that the walls 33''' of the manifolds 21''' and/or the walls of the flame ports 26''' can be at least somewhat uniformly cooled by the water or other liquid, vapor, and/or gas being passed through the passages 23'''. As such, at least a portion of the heat within the walls 33''' and/or the walls of the flame ports 26''' can be transferred to the liquid and removed from the burner head 22''', as the liquid flows through the burner head 22.

Although not illustrated or described with respect to each non-limiting embodiment of the present disclosure, it will be understood that a liquid cooling system, or other cooling system, can be used with each non-limiting embodiment of the present disclosure.

Further to the above, referring to FIGS. 2-5C, the burner head 22 can comprise at least two, or a plurality of (i.e., three or more), flame ports 26 on at least one surface 28 thereof. The burner head 22 can be configured to receive and combust the mixed supply of the oxidizing gas and the fuel from the mixing torch 24 to produce flames 29 at the flame ports 26 (see e.g., FIG. 2). In one non-limiting embodiment, the flame ports 26, and the other flame ports discussed herein, can be uniformly, or substantially uniformly, spaced with respect to each other about the at least one surface 28 so as to better uniformly convey heat. If larger flame ports 26 are used, less flame ports 26 may be required owing to the larger flames produced, when compared to the use of smaller flame ports 26, which may require more flame ports 26. In any event, the flames 29 can overlap each other as they extend from the various flame ports to substantially uniformly heat various forging surfaces.

In one exemplary non-limiting embodiment, the flame ports 26 can have a 0.030 inch diameter or a diameter in the range of 0.015 inches to 0.1 inches, for example. Smaller flame ports can be spaced one half of one inch from other flame ports on the surface 28 of burner head 22, for example, to provide uniform, or substantially uniform, preheating of the forging surface(s) 16 and/or 18 of the forging die 10. Larger flame ports can be spaced one inch from each other, for example, to provide uniform, or substantially uniform, preheating of the forging surface(s) 16 and/or 18 of the forging die 10. Of course, other suitable flame port spacing is within the scope of the disclosure. In one non-limiting embodiment, the flame ports 26 can comprise any suitable shape such as circular, ovate, and/or conical, for example. In other non-limiting embodiments, as will be apparent to those of ordinary skill in the art upon consideration of the present disclosure, any other suitable flame port diameters, shapes, configurations, and/or flame port spacing can be used. In one non-limiting embodiment, the substantially uniformly spaced flame ports can each produce a substantially uniform flame to better provide for substantially uniform preheating of one or more forging surface, for example. In one non-limiting embodiment, the various flame ports 26 can be cleaned after one or more uses, such that none of the flame ports 26 remain or become blocked by combustion residue, debris, or other materials produced by the forging die preheating process. In one non-limiting embodiment, a drill bit, such as a number 69 drill bit, for example, may be used to clean the flame ports 26. In other non-limiting embodiments, an automated computer numerical controlled ("CNC") machine can be programmed to clean the flame ports 26, for example.

With reference to FIGS. 2 and 5A-5C, in one non-limiting embodiment, the burner head 22 can comprise a hollow manifold 21', 21", or 21'" (hereafter "21") configured to mix the supply of the oxidizing gas with the supply of the fuel and/or receive a mixed supply of the oxidizing gas and the fuel from one or more mixing torches 24. The manifold 21 can be in fluid communication with the plurality of flame ports 26 such that it can deliver the mixed supply of the oxidizing gas and the fuel to the flame ports 26 for combustion at the flame ports 26. The passages 23', 23", and/or 23'", described above can extend through and/or surround portions of the manifold 21, for example, for cooling of the burner head 22 through heat transfer to the liquid, vapor, and/or gas flowing through the passages 23', 23" and/or 23'". Although the manifold 21 is illustrated in fluid communication with the flame ports 26 on one surface 28 of the burner head 22, it will be apparent from the disclosure that the manifold can be in fluid communication with flame ports on each of two opposed surfaces of the burner head 22, for example. Further, while the manifold 21 is not illustrated and described with respect to each non-limiting embodiment described in the present disclosure, those of ordinary skill in the art will recognize that a manifold can be supplied in each burner head described herein. In one non-limiting embodiment, the burner head 22 can be configured to receive and combust the mixed supply of the oxidizing gas and the fuel from the manifold 21 to produce the flames 29 at the flame ports 26. The flames 29 can be used to preheat at least a region of at least the first forging surface 16 and/or the second forging surface 18 of the forging die 10.

Figure 6:
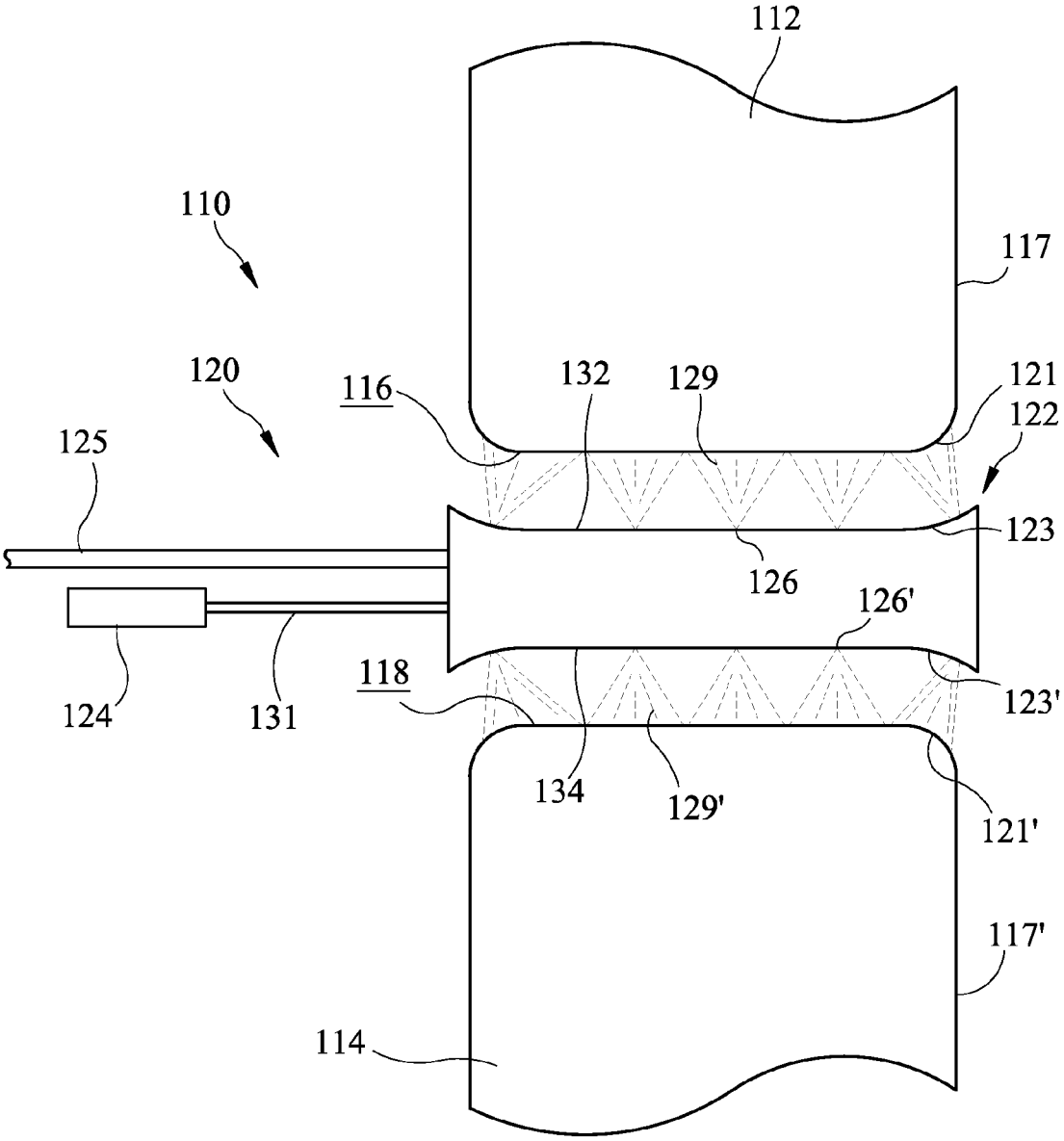
FIGS. 6-11 are schematic illustrations of certain components of various non-limiting embodiments of forging die heating apparatuses according to the present disclosure.

In one non-limiting embodiment, referring to FIG. 6, a first set of at least two flame ports 126 can be provided on a first side or portion 132 of a forging die heating apparatus 120, and a second set of at least two flame ports 126' can be provided on a second side or portion 134 of the forging die heating apparatus 120. By providing these two sets of at least two flame ports 126 and 126', a first forging surface 116 of a top portion 112 of a forging die 100 and a second forging surface 118 of a bottom portion 114 of the forging die 110 can be simultaneously heated by the forging die heating apparatus 120 when the forging die heating apparatus 120 is at least partially positioned intermediate the top portion 112 and the bottom portion 114 of the forging die 110. The burner head 122 and the first and second sets of at least two flame ports 126 and 126' can be in fluid communication with a mixing torch 124, via conduit 131, and can be configured to provide a mixed supply comprising an oxidizing gas and a fuel to the flame ports 126 and 126' and/or to a manifold in fluid communication with the flame ports 126 and 126'. In such an embodiment, the burner head 122 can combust the mixed supply to produce flames 129 and 129' at the first and second sets of at least two flame ports 126 and 126', respectively. In various non-limiting embodiments, the forging die heating apparatus 120 can be shaped to conform to at least one of the first forging surface 116 and the second forging surface 118 of the forging die 110 to enable the forging die heating apparatus 120 to uniformly, or substantially uniformly, preheat at least a portion of the first and/or second forging surfaces 116 and 118 of the forging die 110.

In various non-limiting embodiments, and still referring to FIG. 6, the first and second forging surfaces 116 and 118 can comprise arcuate portions 121 and 121' joining side walls of 117 and 117' and the first and second forging surfaces 116 and 118 of the forging die 110. To uniformly heat these arcuate portions 121 and 121', the burner head 122 can comprise arcuate sections 123 and 123' proximate to ends of the burner head 122, for example, which arcuate sections 123 and 123' can conform to a configuration of the arcuate portions 121 and 121' of the forging surfaces 116 and 118. A burner head 122 provided with these arcuate sections 123 and 123', can more uniformly, or substantially uniformly, heat and conform to both of the arcuate portions 121 and 121' of the first and second forging surfaces 116 and 118, thereby better preventing "cold" spots on the first and second forging surfaces 116 and 118 and/or non-uniform preheating of the forging surfaces 116 and 118. While not specifically described in connection with other non-limiting embodiments discussed in the present disclosure, it will be apparent that the various burner heads can comprise arcuate sections, V-shaped sections, U-shaped sections, convex sections, concave sections, and/or other suitably shaped sections configured to conform to regions of first and/or second forging surfaces of various forging dies, so as to better promote substantially uniform preheating of the forging surfaces or regions of the forging surfaces. In one non-limiting embodiment, line 125 can be used to flow a liquid into the burner head 122 to cool the burner head 122 and/or can be used to move the burner head 122 into an out of a position intermediate the first and second forging surfaces 116 and 118 of the forging die 110.

Figure 7:
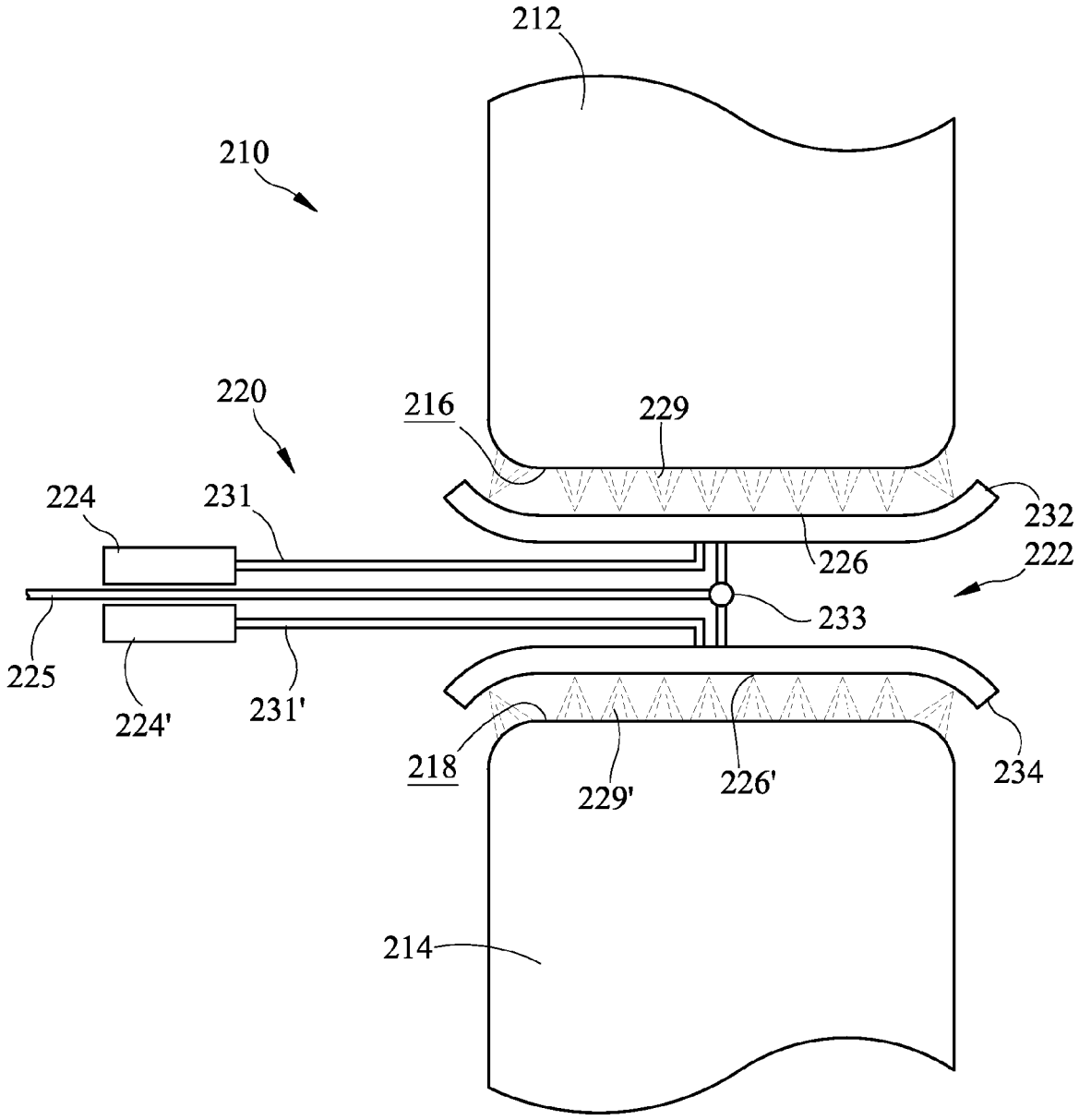

Referring to FIG. 7, a forging die heating apparatus 220 for a forging die 210 can comprise a burner head 222 comprising a first portion 232 and a second portion 234. The first portion 232 can be separate from the second portion 234. The first portion 232 can comprise a first set of at least two flame ports 226 in fluid communication with a mixed supply of an oxidizing gas and a fuel provided by a mixing torch 224 and/or a manifold (not illustrated). The second portion 234 can likewise comprise a second set of at least two flame ports 226' in fluid communication with a mixed supply of an oxidizing gas and a fuel provided by a mixing torch 224' and/or a manifold (not illustrated). The mixing torch 224 can be in fluid communication with the first portion 232 of the burner head 222 via conduit 231 and, similarly, the mixing torch 224' can be in fluid communication with the second portion 234 of the burner head 222 via conduit 231'.

In one non-limiting embodiment, the first portion 232 of the burner head 222 can have a shape conforming to at least a region of a first forging surface 216 of the forging die 210, and the second portion 234 can have a shape conforming to at least a region of a second forging surface 218 of the forging die 210. The first portion 232 can be configured to receive and combust the mixed supply of the oxidizing gas and the fuel to produce a first set of at least two flames 229 at the first set of at least two flame ports 226. The first set of at least two flames 229 can be impinged on the first forging surface 216 of the forging die 210 through the first set of at least two flame ports 226 to heat the first forging surface 216. Likewise, the second portion 234 can be configured to receive and combust the mixed supply of the oxidizing gas and the fuel to produce a second set of at least two flames 229' at the second set of at least two flame ports 226'. The second set of at least two flames 229' can be impinged upon the second forging surface 218 of the forging die 210 through the second set of at least two flame ports 226' to heat the second forging surface 218. In the present disclosure, the terms "impinge" or "impinged", with reference to the various flames, can mean the flames actually contact a forging die surface or can mean that the flames do not actually contact a forging die surface but are positioned proximately close to the forging die surface to suitably convey heat to the forging die surface.

In one non-limiting embodiment, the first set of at least two flame ports 226 can comprise a plurality of uniformly, or substantially uniformly, spaced flame ports 226. Also, the second set of at least two flame ports 226' can comprise a plurality of uniformly, or substantially uniformly, spaced flame ports 226'. The uniform, or substantially uniform, spacing of the flame ports 226 and 226' can better promote uniform, or substantially uniform, preheating of the first and second forging surfaces 216 and 218 of the forging die 210. The uniform, or substantially uniform, spacing of the various flame ports optionally can be a feature of all non-limiting embodiments of forging die heating apparatuses according to the present disclosure. Similar to the non-limiting embodiments described above, a liquid, such as water, for example, can be provided to and removed from the burner head 222 via line 225 and/or other optional lines to cool the burner head 222 during heating of the first forging surface 216 and the second forging surface 218. In one non-limiting embodiment, a valve 233 can be positioned at one end of the line 225. The valve 225 can direct the liquid into and out of the first portion 232 and/or the second portion 234 of the burner head 222, for example.

Figure 8:
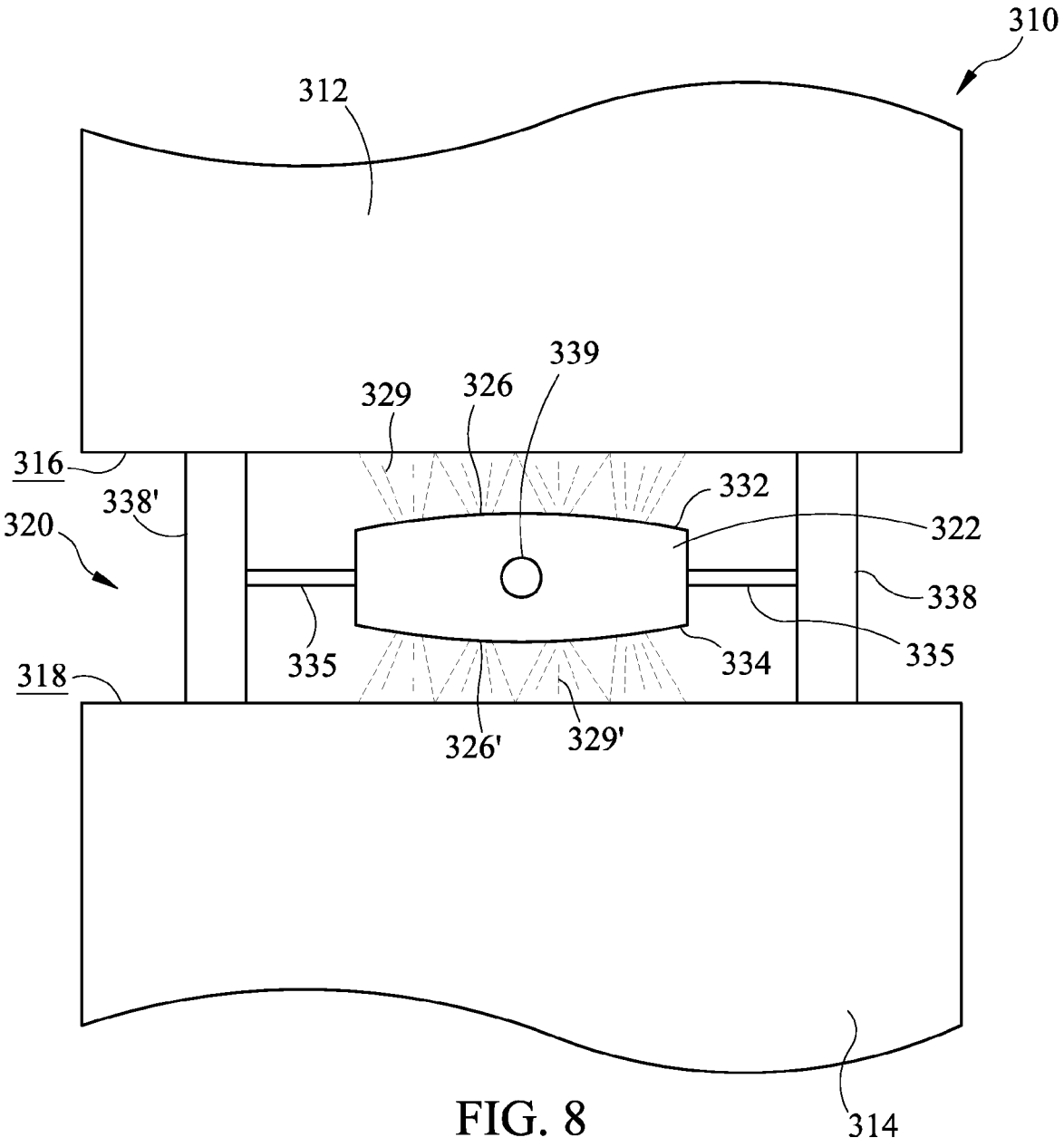

In one non-limiting embodiment, referring to FIG. 8, a forging die heating apparatus 320 for a forging die 310 is provided. The forging die heating apparatus 320 can comprise a burner head 322 configured to receive and combust a mixed supply of an oxidizing gas and a fuel from a mixing torch (not illustrated) and/or a manifold (not illustrated) within the burner head 322. In one non-limiting embodiment, the burner head 322 can comprise a first side or portion 332 and a second side or portion 334. The first portion 332 can comprise at least two flame ports 326, or a first plurality (i.e., three or more) of flame ports 326 and, likewise, the second portion 334 can comprise at least two flame ports 326', or a second plurality of flame ports 326'. Similar to the various non-limiting embodiments discussed above, the at least two flame ports 326 can be used to impinge at least two flames 329 onto a first forging surface 316 of a top portion 312 of the forging die 310 and, similarly, the at least two flame ports 326' can be used to impinge at least two flames 329' onto a second forging surface 318 of a bottom portion 314 of the forging die 310. In various non-limiting embodiments, the at least two flame ports 326 can be uniformly, or substantially uniformly, spaced with respect to each other. Similarly, the at least two flame ports 326' can be uniformly, or substantially uniformly, spaced with respect to each other. As discussed above, such spacing of the various flame ports 326 and 326' can better allow the burner head 322 to uniformly, or substantially uniformly, preheat at least a region of the first and second forging surfaces 316 and 318 of the forging die 310.

Again referring to FIG. 8, in one non-limiting embodiment, a spacer 338 can be provided to prevent or at least inhibit the top portion 312 of the forging die 310 from moving toward the bottom portion 314 of the forging die 310, at least when a portion of the forging die heating apparatus 320 and/or the burner head 322 is positioned at least partially intermediate the top portion 312 and the bottom portion 314. In such an instance, the spacer 338 can be configured to prevent, or at least reduce, the possibility that the forging die heating apparatus 320 and/or the burner head 322 will be crushed between the top portion 312 and the bottom portion 314 of the forging die 310 during a power failure, a malfunction of the forging die 310, or an inadvertent movement of the top and/or bottom portions 312, 314, for example. In one non-limiting embodiment, the burner head 322 can be attached to or integrally formed with a beam 335, which beam 335 can be engaged with, attached to, or integrally formed with a portion of the spacer 338 and/or a portion of a spacer 338'. While a spacer is not illustrated incorporated in each non-limiting embodiment of the present disclosure, it will be apparent that a spacer can be incorporated in or used in conjunction with the various non-limiting embodiments of forging die heating apparatuses discussed in the present disclosure.

In one non-limiting embodiment, the spacer 338 can be comprised of any suitable material having a strength sufficient to withstand the forces by relative movement of the top portion 312 toward the bottom portion 314 of the forging die 310. These materials can comprise, steel or cast steel, for example. In various non-limiting embodiments, more than one spacer 338 can be provided, for example. In such an embodiment, a first spacer 338 can be provided on a first side of the burner head 322 and a second spacer 338' can be provided on a second side of the burner head 322. In certain other non-limiting embodiments, a plurality of spacers can at least partially surround the burner head 322 to suitably protect the burner head 322 from being crushed and/or damaged by the relative movement of the top and bottom portions 312 and 314 of the forging die 310 toward one another. In one non-limiting embodiment, the forging die heating apparatus 320 can comprise the spacer and/or the spacer can be integrally formed with, attached to, separate from, and/or operably engaged with the forging die heating apparatus 320 and/or the burner head 322, for example. In one non-limiting embodiment, the forging die heating apparatus 320 can also comprise a manual or automated actuation arm 339 configured to be used to move at least the burner head 322 into and out of a position intermediate the top portion 312 and the bottom portion 314 of the forging die 310.

Figure 9:
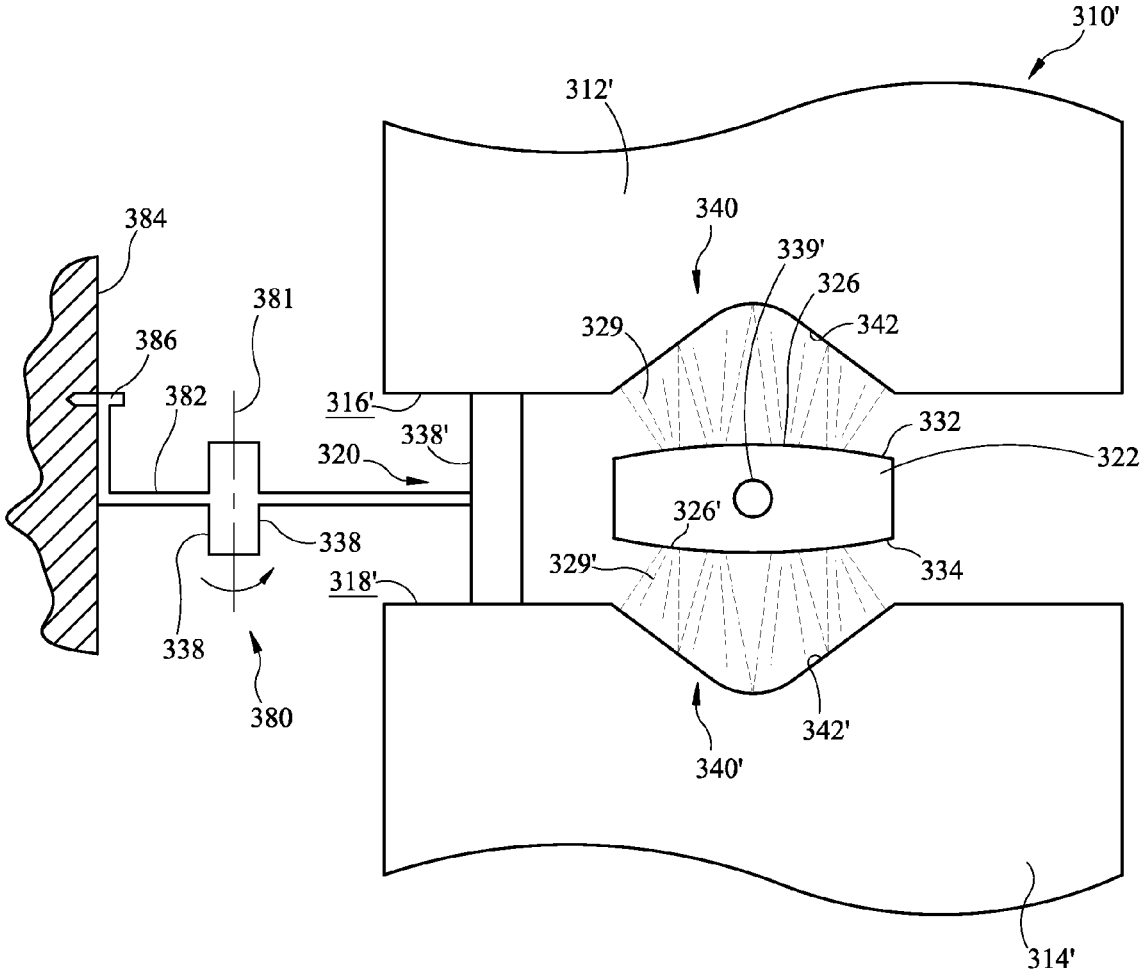

In one non-limiting embodiment, referring to FIGS. 8 and 9, the forging die heating apparatus 320 can be configured for use with forging dies 310 and 310' having various configurations. As illustrated in FIG. 8, the forging die heating apparatus 320 can be configured for use with a flat forging die 310. In other non-limiting embodiments, referring to FIG. 9, the forging die heating apparatus 320 can be configured for use with a vee forging die 310', for example. The vee forging die 310' can comprise a first V-shaped region 340 in a first forging surface 316' and a second V-shaped region 340' in a second forging surface 318'. In such an embodiment, referring to FIG. 9, the flames 329 and 329' respectively produced at the flame ports 326 and 326' can be long enough to impinge on and/or adequately convey heat to all or a region of the side walls 342 and 342' of the V-shaped regions 340 and 340', for example. In certain non-limiting embodiments, the flames 329 and 329' produced by the forging die heating apparatus 320 can be longer when adapted for use with the vee forging die 310' (FIG. 9) than for use with a flat forging die 310 (FIG. 8), for example. In such an instance, a mixing torch (not illustrated) can provide the mixed supply of the oxidizing gas and the fuel to the burner head 322 at a higher velocity, and optionally, at a higher flow rate, when preheating the vee forging die 310' than when preheating the flat forging die 310. In other non-limiting embodiments, the diameter, perimeter, and/or shape of the flame ports 326 and 326' can be suitably adjusted to produce longer flames 329 and 329' at the flame ports 326 and 326' when preheating thefr vee forging die 310', for example. In certain other non-limiting embodiments, which are not illustrated herein, the forging die heating apparatus 320 can be configured for use with any other suitable forging die configuration or forging die surface configuration or orientation. The forging die heating apparatus 320 can also comprise a manual or automatic actuation arm 339' configured to be used to move the at least the burner head 322 into and out of a position at least partially intermediate the top portion 312' and the bottom portion 314' of the forging die 310'.

In one non-limiting embodiment, referring to FIG. 9, a forging die drift equipment safety-hard stop 380 can be configured to prevent or at least inhibit the top portion 312' of the forging die 310' from drifting toward the bottom portion 314' of the forging die 310' during a power failure or at other appropriate times, such as when the forging die 310' is being heated by the burner head 322, for example. The forging die drift equipment safety-hard stop 380 can comprise an arm 382 attached at a first end portion to a wall 384 or other rigid support structure and attached at a second end portion to the spacer 338'. The first end portion of the arm 382 can be attached to the wall via a bolt 386, for example, or by other suitable attachment members or methods, such as welding, for example. In other non-limiting embodiments, the arm 382 can be integrally formed with the wall 384 and/or the spacer 338', for example. In any event, the arm 382 can comprise a swivel member 388 positioned intermediate the first end portion and the second end portion of the arm 382. The swivel member 388 can be used to swivel the spacer 338', about axis 381, between a first position, where it is positioned at least partially intermediate the top portion 312' and the bottom portion 314' of the forging die 310' (as illustrated), and a second position, where the spacer 338' is not positioned intermediate the top portion 312' and the bottom portion 314' of the forging die 310'. The swivel member 388 can be manually actuated or can be automated. The forging die drift equipment safety-hard stop 380 can prevent or at least inhibit the forging die 310' from crushing the burner head 322 during a power failure or at other suitable times, such as when the forging die 310' is being heated by the burner head 322. Although the forging die drift equipment safety-hard stop 380 is illustrated as being used with the forging die 310', it will be understood that the forging die drift equipment safety-hard stop 380 can be used with any of the various forging die disclosed herein or can be used with other suitable forging dies.

Figure 10:
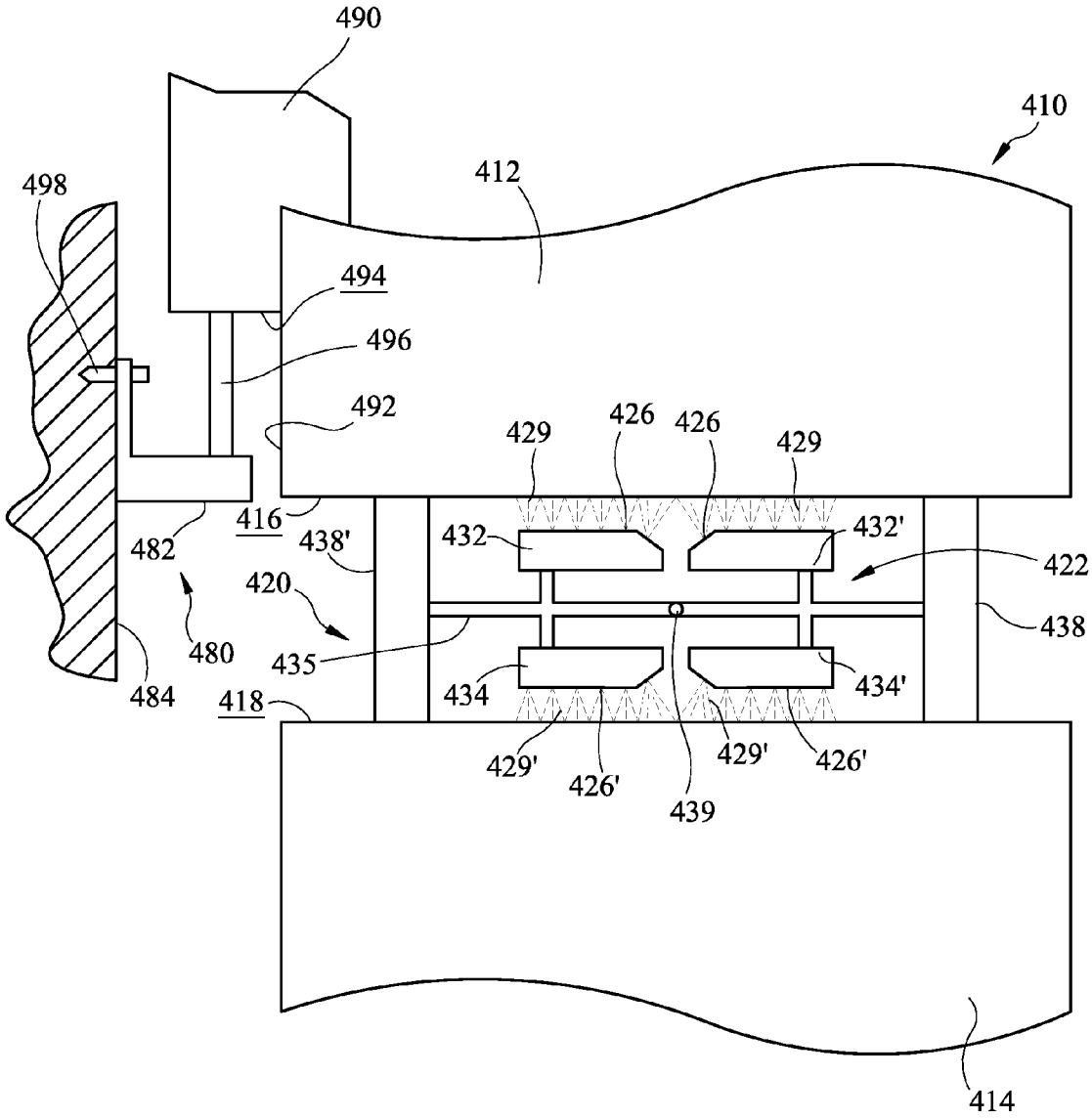
Figure 11:
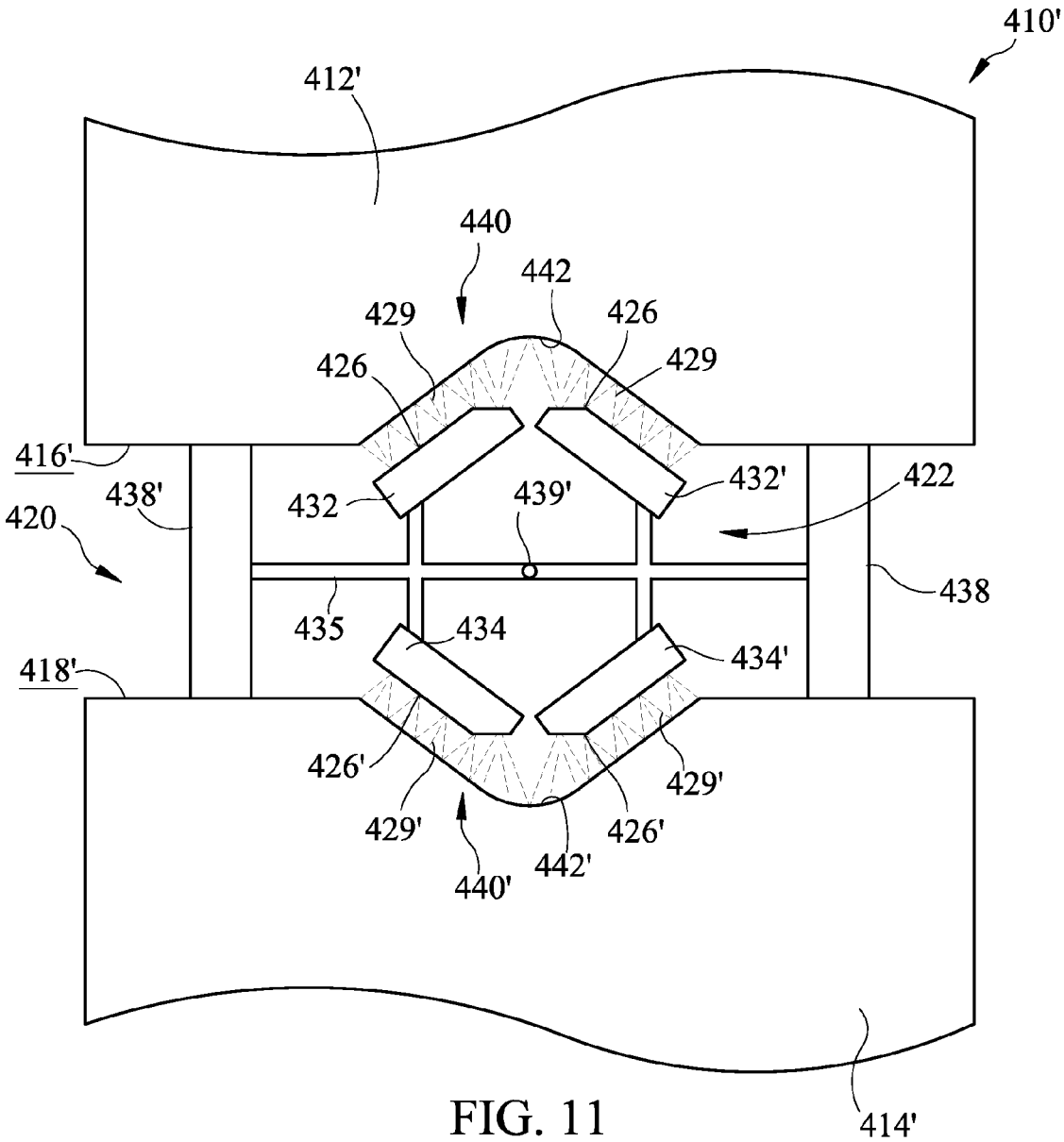

In various non-limiting embodiments, referring to FIGS. 10 and 11, a forging die heating apparatus 420 for a forging die 410 can comprise a burner head 422 comprising a first set of at least two burner portions 432 and 432' and a second set of at least two burner portions 434 and 434'. In other non-limiting embodiments, a burner head can comprise more than four burner portions, for example. The various burner portions can be supported by a cross member 435, which can optionally be engaged with, attached to, or integrally formed with spacers 438 and 438'. The burner portion 432 can be movable with respect to the burner portion 432' and/or with respect to a forging surface 416 of a top portion 412 of the forging die 410 to conform at least a portion of the burner head 422 to an orientation of the forging surface 416 of the forging die 410. By conforming the portion of the burner head 422 to an orientation of the forging surface 416, flame ports 426 located on the burner head 422 can be conformed to the forging surface 416, for example, such that flames 429 can be impinged upon the forging surface 416. The burner portion 432 can be movable manually by an operator or through the use of an actuator, such as a pneumatic actuator, for example. The other burner portions 432', 434, and 434' can also be movable in a similar fashion. In such an embodiment, the burner portions 432, 432', 434, and 434' of the burner head 422 can be moved to conform an orientation of a plurality of flame ports 426 or 426' on the burner portions 432, 432', 434, and 434' to an orientation of a portion of the forging surfaces 416 or 418 of the forging die 410. In various non-limiting embodiments, the burner portions 432, 432', 434, and 434' can be moved to conform an orientation of the plurality of flame ports 426 and 426' on the burner portions 432, 432', 434, and 434' to an orientation of a portion of the forging surfaces 416 and 418 of the flat forging die 410 (see FIG. 10) or the vee forging die 410' (see FIG. 11), for example.

Similar to that discussed above, referring to FIG. 11, the vee forging die 410' can comprise a top portion 412' comprising a first forging surface 416' and a bottom portion 414' comprising a second forging surface 418'. The first forging surface 416' and the second forging surface 418' can comprise V-shaped regions 440 and 440', respectively. The V-shaped region 440 can comprise a side wall 442 and, likewise, the V-shaped region 440' can comprise a side wall 442'. By allowing for movement of the burner portions 432, 432', 434, and 434', the forging die heating apparatus 420 can be configured in an orientation to uniformly, or substantially uniformly, preheat the forging surfaces 416 and 418 and/or the sidewalls 442 and 442' of the V-shaped portions 440 and 440'. The forging die heating apparatus 420 can also comprise or be used with a spacer 438 and/or a spacer 438'. The functionality of the various spacers is described herein with respect to other non-limiting embodiments and will not be repeated here for the sake of brevity. Referring to FIGS. 10 and 11, the forging die heating apparatus 420 can also comprise a manual or automated actuation arm 439 or 439' configured to be used to move at least the burner head 422 into and out of a position intermediate the top portion 412 or 412' and the bottom portion 414 or 414' of the forging die 410 or 410.

In certain non-limiting embodiments, referring to FIG. 10, a forging die drift equipment safety-hard stop 480 can be configured to prevent, or at least inhibit, the top portion 412 of the forging die 410 from drifting toward the bottom portion 414 of the forging die 410 during a power failure or at other appropriate times, such as during heating of the forging die 410, for example. Although, the forging die drift equipment safety-hard stop 480 is illustrated in conjunction with the spacers 438 and 438', it will be recognized that either the spacers 438 and 438' or the forging die drift equipment safety-hard stop 480 can be used independently to perform the same or a similar function (i.e., preventing, or at least inhibiting, the burner head 422 from being crushed between the top portion 412 and the bottom portion 414 of the forging die 410). In one non-limiting embodiment, the top portion 412 of the forging die 410 can be attached to or integrally formed with a bolster 490 (only a portion of the bolster is illustrated). The bolster 490 can extend from a side wall 492 of the top portion 412 of the forging die 410 and can include a surface 494 configured to be engaged with a portion of a removable spacer 496. The forging die drift equipment safety-hard stop 480 can comprise an arm 482 attached to a wall 484 or other rigid support structure at a first end portion and configured to be removably engaged with the removable spacer 496 at a second end portion. The first end portion of the arm 482 can be attached to the wall 484 using a bolt 498, for example, or any other suitable attachment members or methods, such as welding, for example. In one non-limiting embodiment, the arm 482 can be integrally formed with the wall 484, for example. In any event, the removable spacer 496 can be manually or automatically positioned intermediate the surface 494 of the bolster 490 and the second end portion of the arm 482. The removable spacer 496 can be positioned at least partially intermediate the surface 494 and the second end portion of the arm 482 during a power failure and/or during heating of the forging die 410 to prevent, or at least inhibit, the forging die 410 from crushing the burner head 422. Although the forging die drift equipment safety-hard stop 380 is illustrated as being used with the forging die 410, it will be understood that the forging die drift equipment safety-hard stop 480 can be used with any forging die disclosed herein or with other suitable forging dies.

Figure 12:
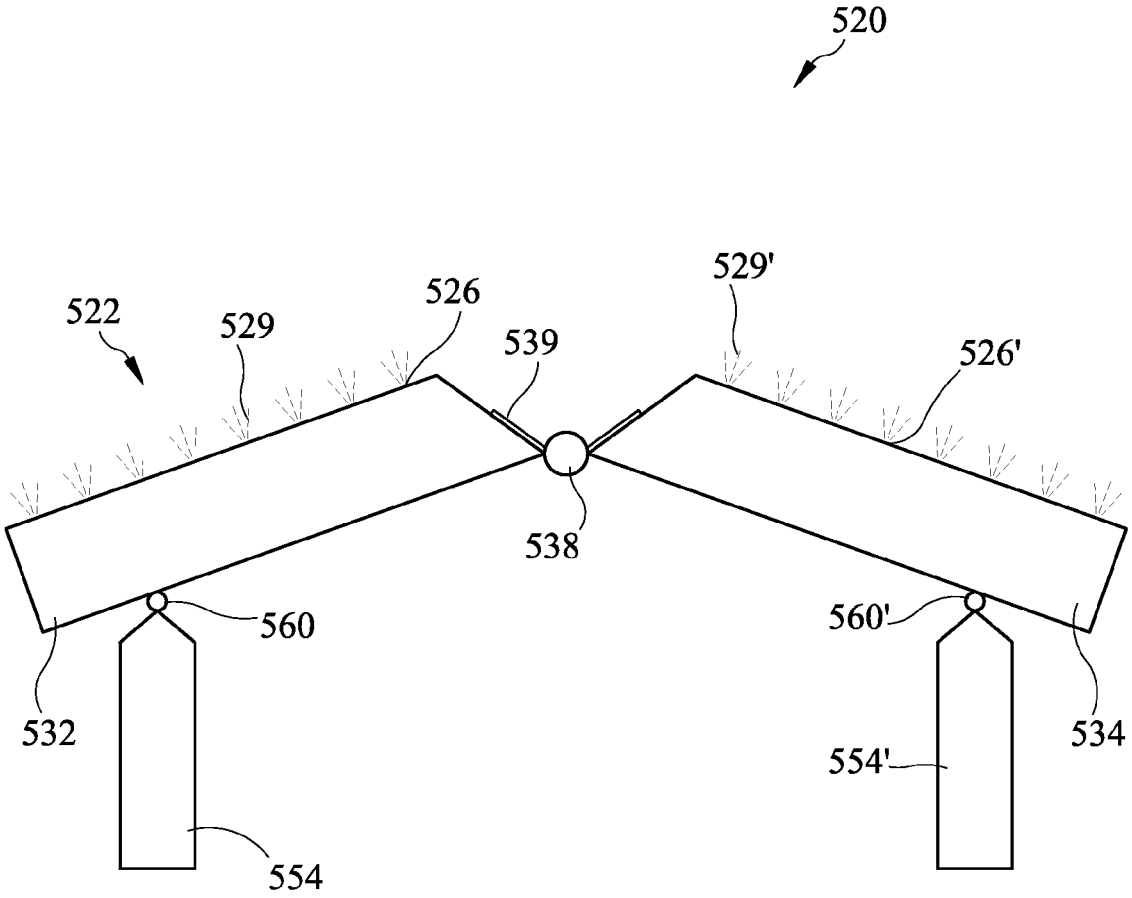
FIG. 12 is a schematic illustration of certain components of another non-limiting embodiment of a forging die heating apparatus according to the present disclosure.

In one non-limiting embodiment, referring to FIG. 12, a forging die heating apparatus 520 for a forging die can comprise a burner head 522 comprising a first portion 532 and a second portion 534. The first portion 532 can be connected to the second portion 534 by a movable member 538, such as a pivot or a hinge, for example, to allow relative movement between the first and second portions 532 and 534. The movable member 538 can be individually attached to the first portion 532 and the second portion 534 by a bracket 539, for example, or through the use of any other suitable attachment member. In other non-limiting embodiments, the movable member 538 can be integrally formed with or fixedly attached to the first portion 532 and/or the second portion 534 of the burner head 522. In any event, the first portion 532 can be moved relative to the second portion 534 and/or relative to a forging surface of a forging die (not illustrated) about the movable member 538 and/or the second portion 534 can be moved relative to the first portion 532 and/or relative to the forging surface of the forging die. Such permitted movement of the burner head 522 can allow flame ports 526 and 526' of the burner head 522 to be conformed to an orientation or configuration of a portion of a forging surface of a forging die such that uniform, or substantially uniform, preheating of the portion of the forging surface can be achieved when flames 529 and 529' are provided at the flame ports 526 and 526'.

In one non-limiting embodiment, the forging die heating apparatus 520 can comprise a member 554 supporting the first portion 532 and a member 554' supporting the second portion 534. The member 554 can be movably attached to the first portion 532 via a pivotable element 560 and, likewise, the member 554' can be movably attached to the second portion 534 via a pivotable element 560'. Such attachment can allow the first portion 532 to move relative to the member 554 and/or the movable member 538, and can allow the second portion 534 to move relative to the member 554' and/or the movable member 538. Such movement can be manually accomplished by an operator of the forging die heating apparatus 520, for example. In one non-limiting embodiment, the forging die heating apparatus 520 can be locked into place after being conformed to forging surfaces of the forging die using any suitable locking mechanisms known to those of ordinary skill in the art.

Figure 13:
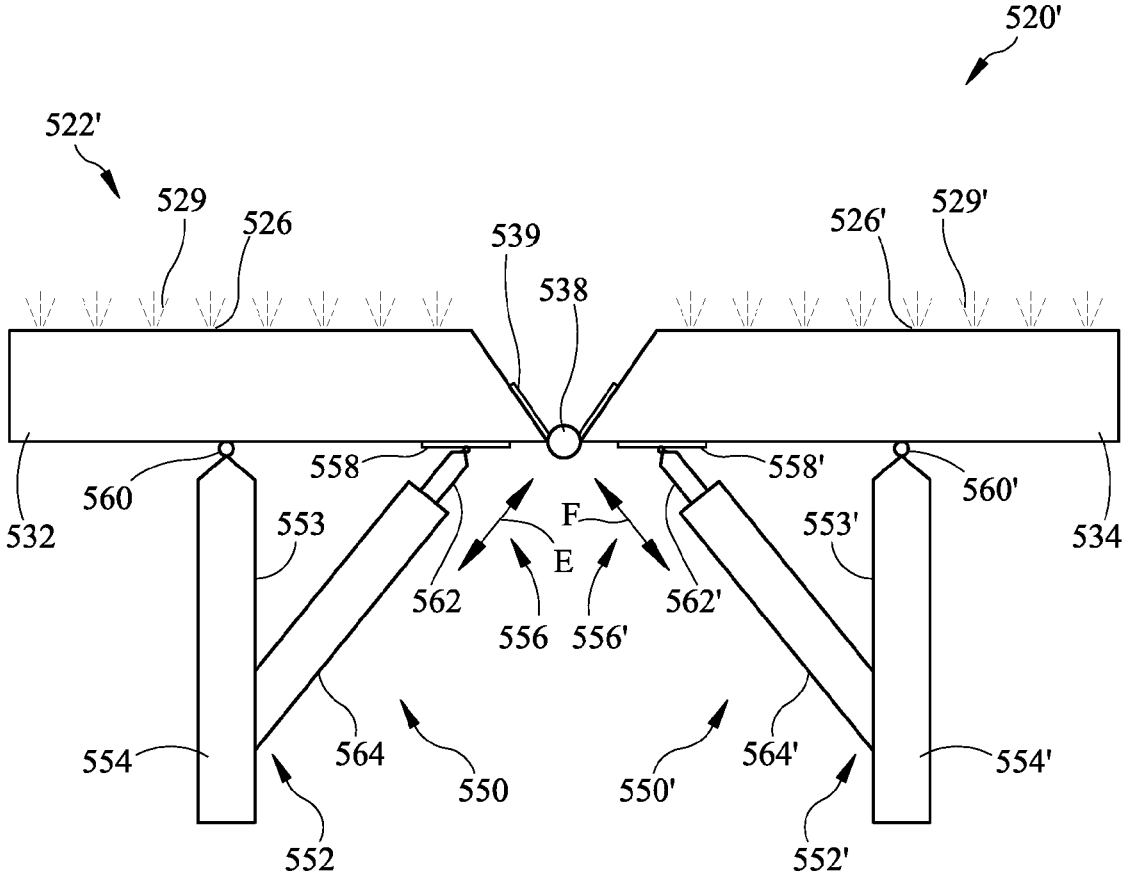
FIG. 13 is a schematic illustration of yet another non-limiting embodiment of a forging die heating apparatus according to the present disclosure, comprising an actuator.

In one non-limiting embodiment, referring to FIG. 13, a forging die heating apparatus 520' can comprise an actuator 550 configured to be operably engaged with the first portion 532 of the burner head 522 to move the first portion 532 about the movable member 538 and/or about the pivotable element 560. In the illustrated exemplary embodiment of FIG. 13, a first end 552 of the actuator 550 can be attached to or formed with the member 554 supporting the first portion 532 of the burner head 522', and a second end 556 of the actuator 550 can be attached to or formed with the first portion 532 of the burner head 522' via a bracket and pivot member 558. The actuator 550 can extend at any suitable angle with respect to a side wall 553 of the member 554. The member 554 can also be movably attached to the first portion 532 of the burner head 522' via the pivotable element 560. The bracket and pivot member 558 and the pivotable element 560 can allow the first portion 532 to move relative to the movable member 538, the member 554, and/or the second portion 534 of the burner head 522'. Of course, an actuator could also be provided which can move both the first portion 532 and the second portion 534 of the burner head 522'.

In one non-limiting embodiment, still referring to FIG. 13, an optional second actuator 550' can be provided to move the second portion 534 of the burner head 522' in a manner similar to the first portion 532 of the burner head 522'. More particularly, a first end 552' of the actuator 550' can be attached to a member 554' supporting the second portion 534 of the burner head 522', and the second end 556' of the actuator 550' can be attached to the second portion 534 of the burner head 522' via a bracket and pivot member 558'. Similar to the actuator 550 described above, the actuator 550' can extend at any suitable angle with respect to a side wall 553' of the member 554'. Also, the member 554' can be movably attached to the second portion 534 of the burner head 522' via a pivotable element 560'. As a result, the actuators 550 and 550' can move the first and second portions 532 and 534 of the burner head 522' relative to each other and/or relative to a forging surface of a forging die. In one non-limiting embodiment, the various movable or pivotable components of the forging die heating apparatus 520' can be lubricant-free, high-temperature resistant, and designed to operate in close proximity to the burner head 522'.

Figure 14:
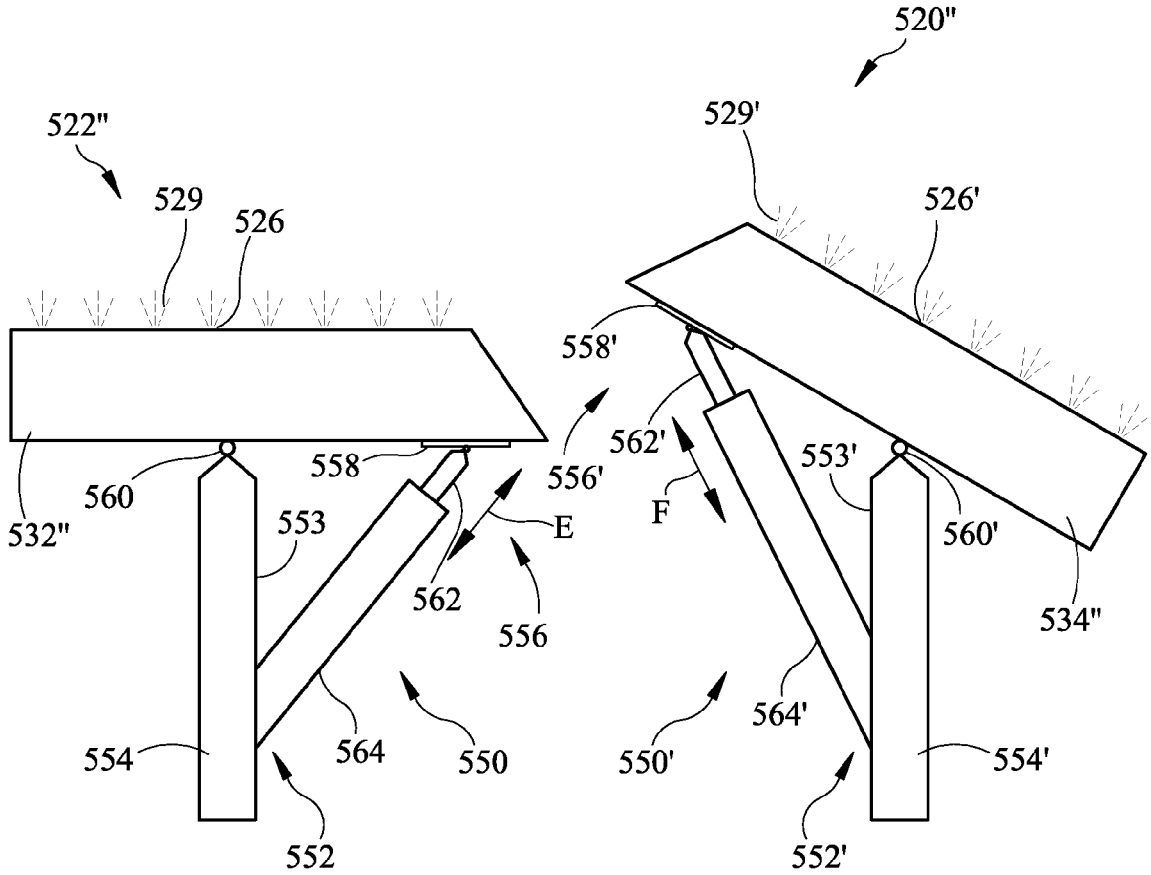
FIG. 14 is a schematic illustration of still another non-limiting embodiment of a forging die heating apparatus according to the present disclosure, comprising an actuator.

In one non-limiting embodiment, referring to FIG. 14, actuators 550 and 550' can be used in conjunction with forging die heating apparatus 520". Forging die heating apparatus 520" can comprise a burner head 522" comprising a first portion 532" and a second portion 534" that are independent of each other (i.e., not connected by a movable member, such as movable member 538). In various circumstances, it may be desirable to have the first and second portions 532" and 534" independent from each other to allow for a greater degree of movement of the first second portions 532" and 534" about each other and/or with respect to a forging surface of a forging die. Stated another way, by not connecting the first and second portions 532" and 534", an operator using the forging die heating apparatus 520" can configure the first and second portions 532" and 534" of the forging die heating apparatus 520" into any suitable configuration and/or orientation.

In one non-limiting embodiment, referring to FIGS. 13 and 14, the actuators 550 and 550' can be comprised of compressed air, mechanical, electrical, hydraulic, pneumatic, and/or any other suitable type of actuators configured to be used in a high temperature environment. In one non-limiting embodiment, the actuators 550 and 550' can comprise compressed air-actuated pistons 562 and 562', respectively, which can extend and retract from housings 564 and 564', respectively, to move the first portion 532 or 532" and the second portion 534 or 534" relative to each other and/or relative to a forging surface of a forging die. In one non-limiting embodiment, piston 562 can move in the directions indicated by arrow "E" and piston 562' can move in the directions indicated by arrow "F", for example. In other various non-limiting embodiments, any suitable number, configuration, or type of actuators can be provided with or used with the forging die heating apparatuses described herein. In one non-limiting embodiment, the various actuators can be configured to move at least a portion of the burner head at least between a first configuration and a second configuration to at least partially conform the flame ports of the burner head to the orientation of a region of various forging surfaces of a forging die.

In one non-limiting embodiment, the mixed supply of oxidizing gas and fuel supplied to the various flame ports can be at least partially comprised of an air-aspirated fuel, for example, and/or any other suitable oxidizing gas and/or fuel. The oxidizing gas is provided in the mixed supply of the oxidizing gas and the fuel to facilitate combustion of the fuel. In one non-limiting embodiment it may be desirable to achieve faster and/or higher temperature preheating of forging surfaces of forging dies. In such an embodiment, the supply of the oxidizing gas can be predominantly or substantially oxygen, and the supply of fuel can be any suitable fuel that can be combusted in the presence of oxygen, such as acetylene, propylene, liquefied petroleum gas (LPG), propane, natural gas, hydrogen, and MAPP gas (a stabilized mixture of methylacetylene and propadiene), for example. By combusting such a fuel with an oxidizing gas predominantly or substantially comprised of oxygen, faster and higher-temperature heating of the forging surfaces of the forging dies can be achieved relative to combusting the fuel using ambient air as the oxidizing gas. Given that ambient air comprises only about 21 volume percent oxygen, preheating techniques using air as the oxidizing gas to facilitate combustion of the fuel can increase the time required for preheating and reduce the temperature of the forging surface achieved through preheating. Using a mixed supply comprising an oxygen-combustible fuel and an oxidizing gas comprised predominantly of oxygen (referred to herein as an "oxy-fuel"), the various non-limiting forging die heating apparatuses and methods of the present disclosure can relatively rapidly (for example, in 5 to 10 minutes) preheat all of or a region of a forging surface of a forging die to temperatures in the range of 700° F. to 2000° F., for example. Such temperatures are significantly higher than temperatures achieved in certain conventional forging die preheating techniques. Additionally, the use of an oxy-fuel can significantly reduce the time required to preheat the forging dies and/or the forging surfaces of the forging dies to the required temperature and can achieve a higher temperature preheat, thereby eliminating or at least minimizing the temperature differential between a heated work piece and the forging surfaces.

In one non-limiting embodiment, the present disclosure, in part, is directed to a method of heating a forging die or at least a region of a forging surface of a forging die. The method can comprise positioning a burner head comprising at least two flame ports in proximity to at least a region of a forging surface of the forging die and supplying a fuel, such as an oxy-fuel, for example, and an oxidizing gas to the at least two flame ports. The oxy-fuel can then be combusted at the at least two flame ports to produce a flame, such as an oxy-fuel flame, for example, at each of the at least two flame ports. The at least two flames can then be impinged onto at least the region of the forging surface of the forging die to uniformly, or substantially uniformly, heat the region of the forging surface of the forging die.

In one non-limiting embodiment, the method can comprise using a burner head comprising a first portion comprising a first set of flame ports comprising at least two flame ports and a second portion comprising a second set of flame ports comprising at least two flame ports. The method can further comprise moving at least one of the first portion and the second portion relative to a forging surface of a forging die. As such, an orientation of at least the first set of flame ports can be at least partially conformed to an orientation of a region of the forging surface of the forging die. In other non-limiting embodiments, the method can comprise using a burner head comprising a first portion comprising a first set of flame ports comprising at least two flame ports and a second portion comprising a second set of flame ports comprising at least two flame ports. The method can further comprise moving the burner head from a first configuration to a second configuration relative to the forging surface of the forging die using an actuator operably engaged with the burner head. As such, an orientation of at least the first set of flame ports can be at least partially conformed to an orientation of a region of the forging surface of the forging die. The method can further comprise using a forging die comprising a first forging surface and a second forging surface, and positioning the burner head intermediate the first forging surface and the second forging surface during the heating of the region of the forging surface. In one non-limiting embodiment, the burner head can be positioned a distance of 0.5 inches to 8 inches, a distance of 1 inch to 6 inches, or a distance of 1.5 inches to 3 inches, for example, from the region of the forging surface of the forging die prior to impinging the at least two flames onto the region of the forging surface. In various non-limiting embodiments, the burner head can be positioned, parallel, or substantially parallel, to the region of the forging surface of the forging die during flame impingement. In various other non-limiting embodiments, the burner head can comprise a surface having an area which corresponds to and/or is substantially the same as an area of the forging surface.

In one non-limiting embodiment, the method can comprise monitoring the temperature of at least a portion of a forging die and intermittently impinging, based on the monitoring, at least two flames, such as oxy-fuel flames, for example, onto a forging surface of the forging die to adjust the temperature of at least the portion of the forging surface and/or the forging die to at least a minimum desired temperature. In such non-limiting embodiments, thermocouples, thermopiles, fiber optic infra-red sensors, heat flux sensors, and/or other devices suitable for converting thermal energy into electrical energy (together referred to herein as "temperature sensors") can be positioned within the forging die, around the perimeter of the forging die, on forging surfaces of the forging die, and/or within the flame ports of the burner head, for example, such that an operator of a forging die heating apparatus can receive feedback as to the temperature of the forging surfaces of the forging die during a forging die preheating process. In one non-limiting embodiment, the temperature sensors can be rated for sensing temperatures in the range of 800-3000° Fahrenheit, for example. Suitable temperature sensors such as thermocouples, for example, are readily commercially available and, therefore, are not discussed further herein.

Figure 15:
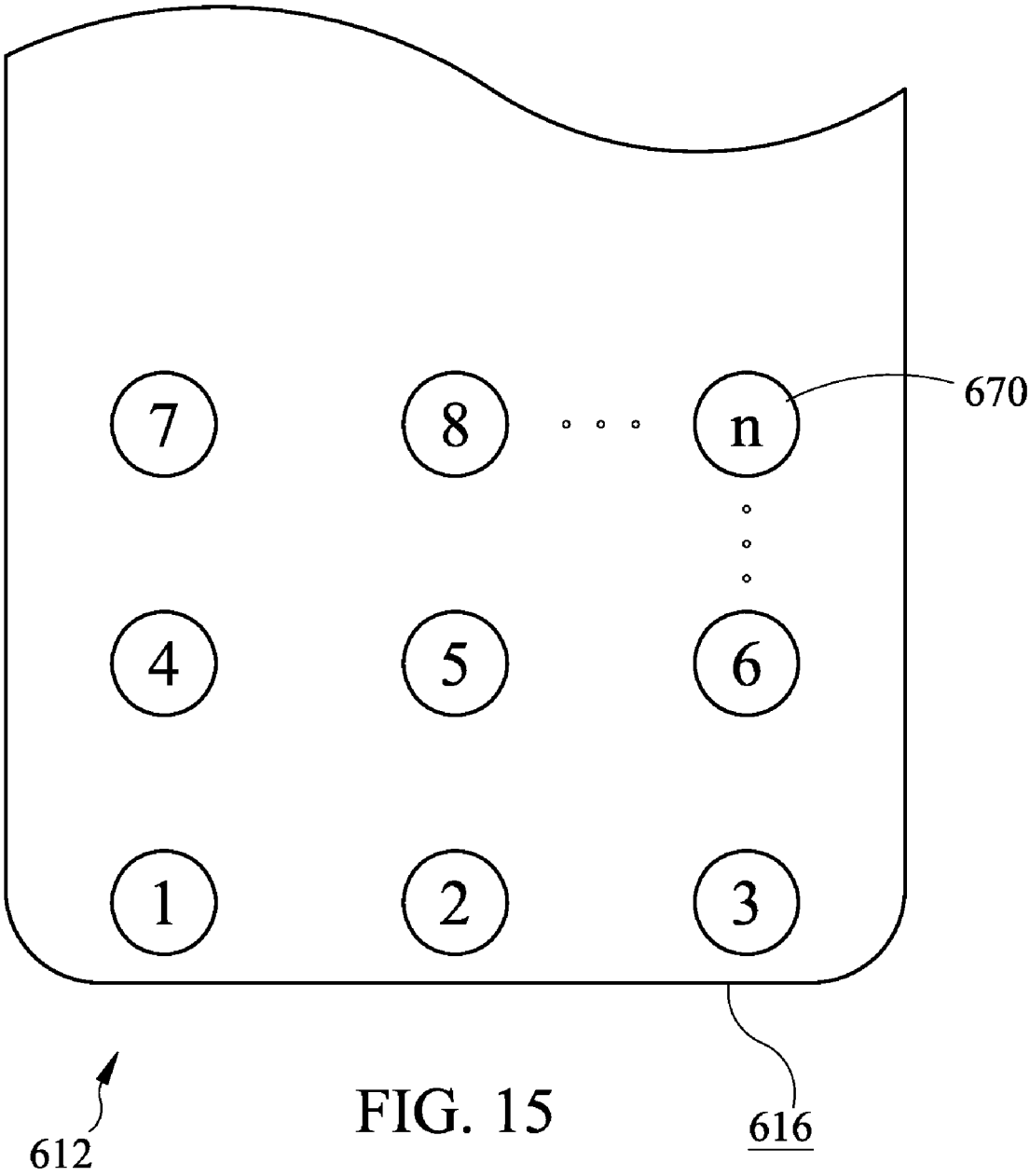
FIG. 15 is a schematic illustration of a portion of a forging die comprising a plurality of sensors for monitoring the temperature of various regions of the forging die according to one non-limiting embodiment of the present disclosure.

One exemplary non-limiting embodiment of the positioning of the temperature sensors that may be used in certain embodiments according to the present disclosure is illustrated in FIG. 15. As illustrated, one or more temperature sensors 670, which are indicated by the numbers 1-n, where n is a suitable integer, can be positioned on and/or within a top portion 612 of a forging die, for example. The temperature sensors 670 can be positioned within the top portion 612 by drilling holes in the top portion 612 and then inserting the temperature sensors 670 into the holes, for example. Of course, similar temperature sensors, or other types of temperature sensors, can be positioned on and/or within a bottom portion (not illustrated) or other portion of the forging die. The positions of the temperature sensors 1-n can allow accurate monitoring of the temperature, or temperature range, whether absolute, differential, or gradient, of the top portion 612 of the forging die and/or the forging surface 616 of the top portion 612. The temperature sensors 1-n can also be used to validate a forging die heating rate when using a particular fuel, such as oxy-fuel, for example. Those of skill in the art will recognize that the temperature sensors 670 can be positioned within the top portion 612 (and/or the bottom portion), and/or on or near the forging surface 616 of the top portion 612 (and/or the bottom portion), in any suitable position, arrangement, and/or orientation.

Figure 16:
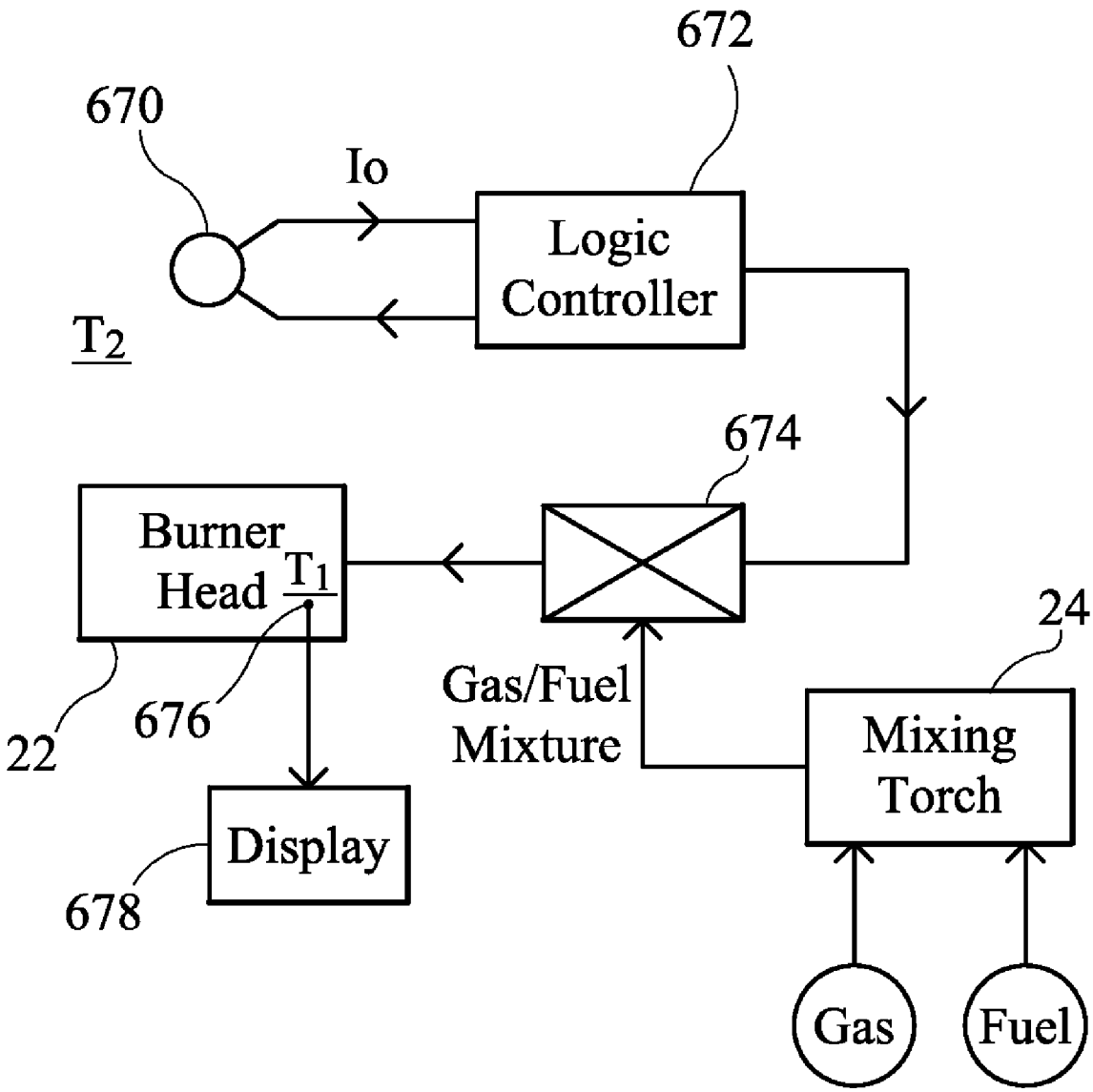
FIG. 16 is a flow chart of a closed loop on/off flame impingement system according to one non-limiting embodiment of the present disclosure.

In one non-limiting embodiment, referring to FIGS. 2, 15, and 16, a closed-loop on/off flame impingement system can be provided for temperature control of at least a portion of the forging die and/or the forging surface 616 of the forging die. Electrical energy (e.g., voltage or current) output signals from the temperature sensors 670, indicative of the temperature T2 of a portion of the forging die and/or the forging surface 616, can be received by a logic controller 672, such as a programmable logic controller (PLC) or other suitable logic controller, for example. The logic controller 672 converts the electrical energy received from the temperature sensors 670, which is proportional to temperature T2, into an electrical signal suitable for feedback control. For example, in one non-limiting embodiment, the logic controller 672 converts the electrical energy from the temperature sensors 670 into a series of pulses or other signals suitable for controlling the operation of a normally-closed solenoid valve 674, or other suitable valve, to control the opening and closing of the solenoid valve 674. In various non-limiting embodiments, the solenoid valve 674 can be positioned in the conduit 31 (or other conduit), such that it can be located intermediate a mixed supply of an oxidizing gas and a fuel in the mixing torch 24 and the burner head 22 (see e.g., FIG. 2). In other non-limiting embodiments, a solenoid valve can be positioned in each of the lines or conduits (not illustrated) supplying the oxidizing gas and/or the fuel to the mixing torch 24, for example. In any event, the solenoid valve 674 can be opened or closed based on the series of pulses or signals outputted by the logic controller 672. In one non-limiting embodiment, the logic controller 672 may be configured such that when the temperature of the forging surface 616 and/or portions of the forging die are within or above a predetermined required temperature or required temperature range, the logic controller 672 maintains the solenoid valve 674 in a closed position to prevent the flow of the mixed supply of the oxidizing gas and the fuel to the burner head 22 for combustion. Still in one non-limiting embodiment, when the temperature of the forging surface 616 and/or portions of the forging die are below the predetermined required temperature or the required temperature range, the logic controller 672 can output pulses or signals that cause the solenoid valve 674 to open and thus enable the flow of the mixed supply of the oxidizing gas and the fuel to the burner head 22 for combustion. In one non-limiting embodiment, a proportional-integral-derivative ("PID") controller (not illustrated) can be used in the closed loop on/off flame impingement system in lieu of the local controller 672, as is known to those of ordinary skill in the art. The PID controller can be used to control the opening and/or closing of the solenoid valve 674 to at least intermittently heat the forging surface 616 and/or other portions of the forging die to the predetermined required temperature or the predetermined required temperature range. In various non-limiting embodiments, and, of course, depending on the material composition of the forging dies, the temperature can be maintained between 700 and 2000 degrees Fahrenheit, when using an oxy-fuel, for example.

In one non-limiting embodiment, and referring to FIG. 16, a fiber optic infra-red thermometer 676, sensor, or other suitable temperature sensing device (together referred to herein as a "temperature sensor") can be positioned within or proximate to the flames extending from a flame port of the burner head 22 to measure the temperature T1 of the burner head 22, the flames, and/or the temperature of the forging surface 616. In other non-limiting embodiments, more than one temperature sensor 676 can be provided in one or more than one flame extending from or positioned within the flame ports of the burner head 22. Suitable temperature sensors are commercially available from Mikron, Ameteck, or Omega Instruments, for example. Such temperature sensors can provide an electrical signal proportional to thermal energy of the flame or the forging surface, for example. In one non-limiting embodiment, the temperature sensor 676 can be included in the closed-loop on/off flame impingement system described above to provide flame temperature and/or forging surface temperature T1 feedback to an operator. In one non-limiting embodiment, the flame temperature and/or forging surface temperature T1 feedback can be displayed on a display 678, such as a liquid crystal display, for example. Those skilled in the art will appreciate that the electrical energy output of the temperature sensors may be read directly by circuitry provided within the display 678. Although the closed-loop on/off flame impingement system is described with respect to one non-limiting embodiment of the disclosure, it will be understood that it can be used with each non-limiting embodiment or other various embodiments.

Figure 17:
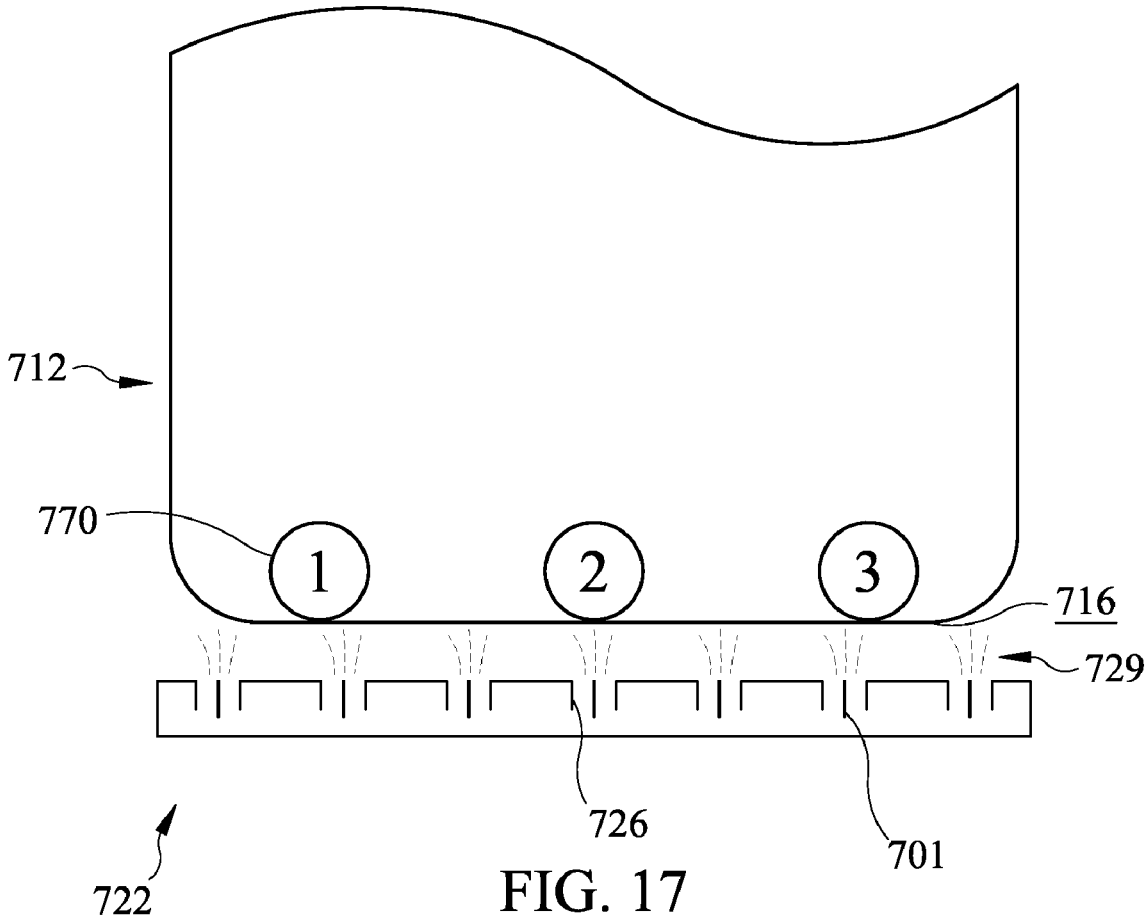
FIG. 17 is a schematic illustration of a portion of a forging die comprising a plurality of sensors for monitoring the temperature of various regions of the forging die and/or the forging die surface according to one non-limiting embodiment of the present disclosure.

In one non-limiting embodiment, referring to FIG. 17, one or more fiber optic infra-red thermometers, sensors, or other temperature sensing devices (together referred to as "temperature sensors 701") can be positioned within flame ports 726 of a burner head 722 of a forging die heating apparatus. The burner head 722 can be similar to the various burner heads described herein. In one non-limiting embodiment, the burner head 722 can be positioned proximate to the forging surface 716 of the top portion 712 of a forging die such that flames 729 emitted from the flame ports 722 can be impinged upon the forging surface 716. The temperature sensors 701 can sense the thermal energy of the forging surface 716 and convert the thermal energy into electrical energy.

Optional temperature sensors 770, labeled 1-3, can be positioned on and/or within the top portion 712 of the forging die and proximate to the forging surface 716 to measure the temperature of regions of the top portion 712. Of course, similar temperature sensors, or other types of temperature sensors, can be positioned on and/or within a bottom portion (not illustrated) or other portion of the forging die. The temperature sensors 770 can be the same as or similar to the temperature sensors 670 described above and, therefore, will not be described in detail with respect to FIG. 17 for the sake of brevity.

Figure 18:
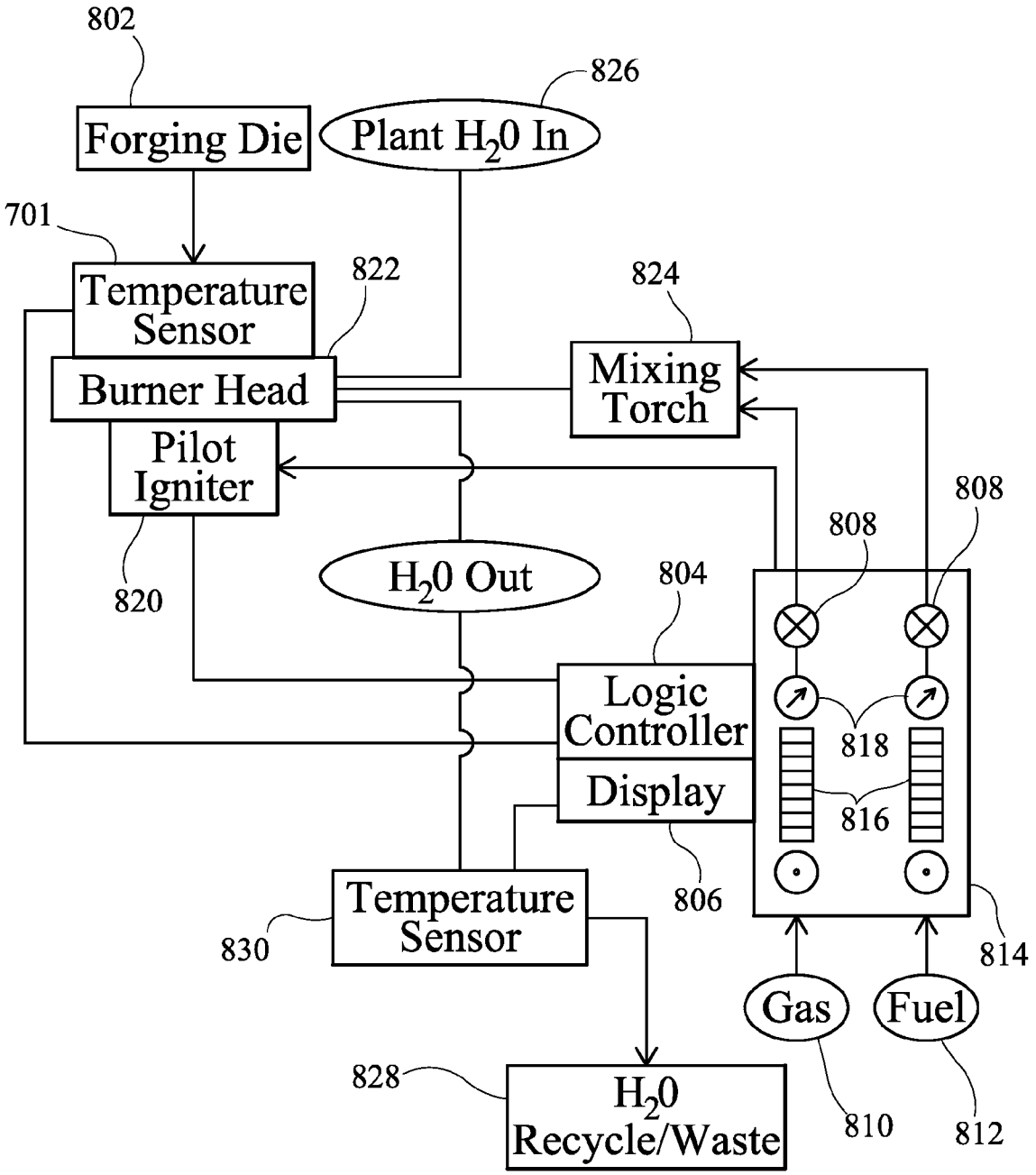
FIG. 18 is a flow chart of a closed loop on/off flame impingement system according to one non-limiting embodiment of the present disclosure.

In one non-limiting embodiment, referring to FIG. 18, a different closed-loop on/off flame impingement system can be provided for temperature control of at least a region of the forging die and/or the forging surface 716 of the forging die. In one non-limiting embodiment, the temperature sensors 701 can read the thermal energy of the forging surface 716 of the forging die 802 and output electrical energy (e.g., voltage or current) indicative of the temperature of the forging surface 716, to a logic controller 804. The logic controller 804 can be a programmable logic controller (PLC) or other suitable logic controller, for example, and can be associated with a display 806, such as a liquid crystal display, for example, to provide feedback of the temperature of the forging surface 716 to an operator of a forging die heating apparatus. The display 806 can include the appropriate circuitry to interpret the electrical energy supplied by the temperature sensors 701 and display an output indicative of the temperature of the forging surface. In one non-limiting embodiment, the logic controller 804 can convert the electrical energy received from the temperature sensors 701 into a format for outputting to the display 806. The logic controller 804 can also interpret the electrical energy received from the temperature sensors 701 and convert the electrical energy into a series of pulses or other signals suitable for controlling (i.e., opening and/or closing) one or more solenoid valves 808, or other suitable valves, to control the amount of oxidizing gas and fuel that is fed into a mixing torch 824 at a particular time. The solenoid valves 808 can be positioned on lines between a supply of the oxidizing gas 810 and the mixing torch 824 and a supply of the fuel 812 and the mixing torch 824. The amount of the oxidizing gas and the fuel fed into the mixing torch 824 can be proportional to the temperature of the forging surface 716. Stated another way, the amount of the oxidizing gas and the fuel fed into the mixing torch 824 can be based on the differential between the temperature of the forging surface 716 and a predetermined required temperature, or a predetermined required temperature range, of the forging surface 716. As such, if the temperature of the forging surface 716 is below the predetermined required temperature, or the predetermined required temperature range, the oxidized gas and the fuel can be fed into the mixing torch 824 as the pulses, or other signals, from the logic controller 804 will instruct the solenoid valve to open, partially open, or remain open. If the temperature of the forging surface 716 is above the predetermined required temperature, or the predetermined required temperature range, the oxidized gas and the fuel may not be fed into the mixing torch 824 as the pulses or signals from the logic controller 804 will instruct the solenoid valve 808 to close, partially close, or remain closed. Upon consideration of the present disclosure, those of skill in the art will recognize that various amounts of the oxidizing gas and the fuel can be intermittently fed into the mixing torch 824 as the solenoid valves 808 open and/or close after receiving various pulses, or other signals, from the logic controller 804 to maintain the temperature of the forging surface 716 at the predetermined required temperature, or the predetermined required temperature range.

In another non-limiting embodiment, a proportional-integral-derivative ("PID") controller (not illustrated), as is known to those of ordinary skill in the art, can be used in the closed loop on/off flame impingement system in lieu of the logic controller 804. The PID controller can be used to control the opening and/or closing of the solenoid valves 808 in a similar fashion as the logic controller 804. In various non-limiting embodiments, and, of course, depending on the material composition of the forging dies and/or the burner head 822, the temperature can be maintained between 700 and 2000 degrees Fahrenheit, when using an oxy-fuel, for example.

In one non-limiting embodiment, the oxidizing gas and the fuel can be fed into a flow regulator 814. The flow regulator 814 may include flow rate gauges 816 and pressure gauges 818 for monitoring the flow rate and pressure, respectively, of the oxidizing gas and the fuel through the flow regulator 814. The flow regulator 814 may also include the solenoid valves 808, which are configured to open and close based on pulses, or signals, received from the logic controller 804. If the solenoid valves 808 are open, or partially open, the oxidizing gas and the fuel can be fed through the flow regulator 814 and, if the solenoid valves 808 are closed, the oxidizing gas and the fuel will not be allowed to flow through the flow regulator 814. As such, the logic controller 804 can send pulses, or signals, to the solenoid valves 808 to open and/or close the solenoid valves 808 and intermittently permit the flow of the oxidizing gas and the fuel through the flow regulator 814. Of course, the flow rate of the oxidizing gas and the flow rate of the fuel can have any suitable ratio suitable for adequate combustion.

In one non-limiting embodiment, still referring to FIG. 18, once the oxidizing gas and the fuel exits the flow regulator 814, these can enter the mixing torch 824, such that the oxidizing gas can be mixed with the fuel and then fed into burner head 822, or a manifold within the burner head 822, for combustion. When the oxidizing gas and fuel mixture is fed into the burner head 822, or the manifold within the burner head 822, a pilot igniter 820 can be activated, via pulses or signals received from the logic controller 804, to ignite the mixed supply of the oxidizing gas the fuel.

As discussed above, the burner head 822 can be cooled using a liquid, vapor, and/or a gas, for example. In one non-limiting embodiment, water 826 from a facility can be fed into the burner head 822, run through the burner head 822 to cool the burner head 822 by absorbing heat from the metal portions of the burner head 822, and then flowed out of the burner head 822 to a water recycle or waste pit 828 or other suitable waste area. A temperature sensor 830 can be provided in the waste line between the burner head 822 and the water recycle or waste pit 828 to track the temperature of the waste water. The temperature of the waste water may, in some instances, indicate to an operator that the burner head 822 is overheating. In one non-limiting embodiment, the temperature of the waste water may normally be above the ambient temperature and/or within the range of 60 degrees Fahrenheit to 90 degrees Fahrenheit, for example, depending on the flow rate of the waste water. If the temperature of the waste water reaches about 110 degrees Fahrenheit, for example, this may indicate that the burner head 822 is overheating and should be shut down or that more cooling water should be provided to the burner head 822. In other non-limiting embodiments, if the temperature sensor 830 senses a temperature of the waste water at approximately 110 degrees Fahrenheit, for example, the burner head 822 may be automatically shut down or more cooling water may be automatically provided to the burner head 822. Those of skill in the art will recognize that the temperature sensor 830 can read thermal energy of the waste water and convert that thermal energy into electrical energy. The electrical energy can then be provided to the display 806. As referenced above, the display 806 may include the appropriate circuitry to interpret the electrical energy and provide a readout indicative of the temperature of the waste water.

Figure 19:
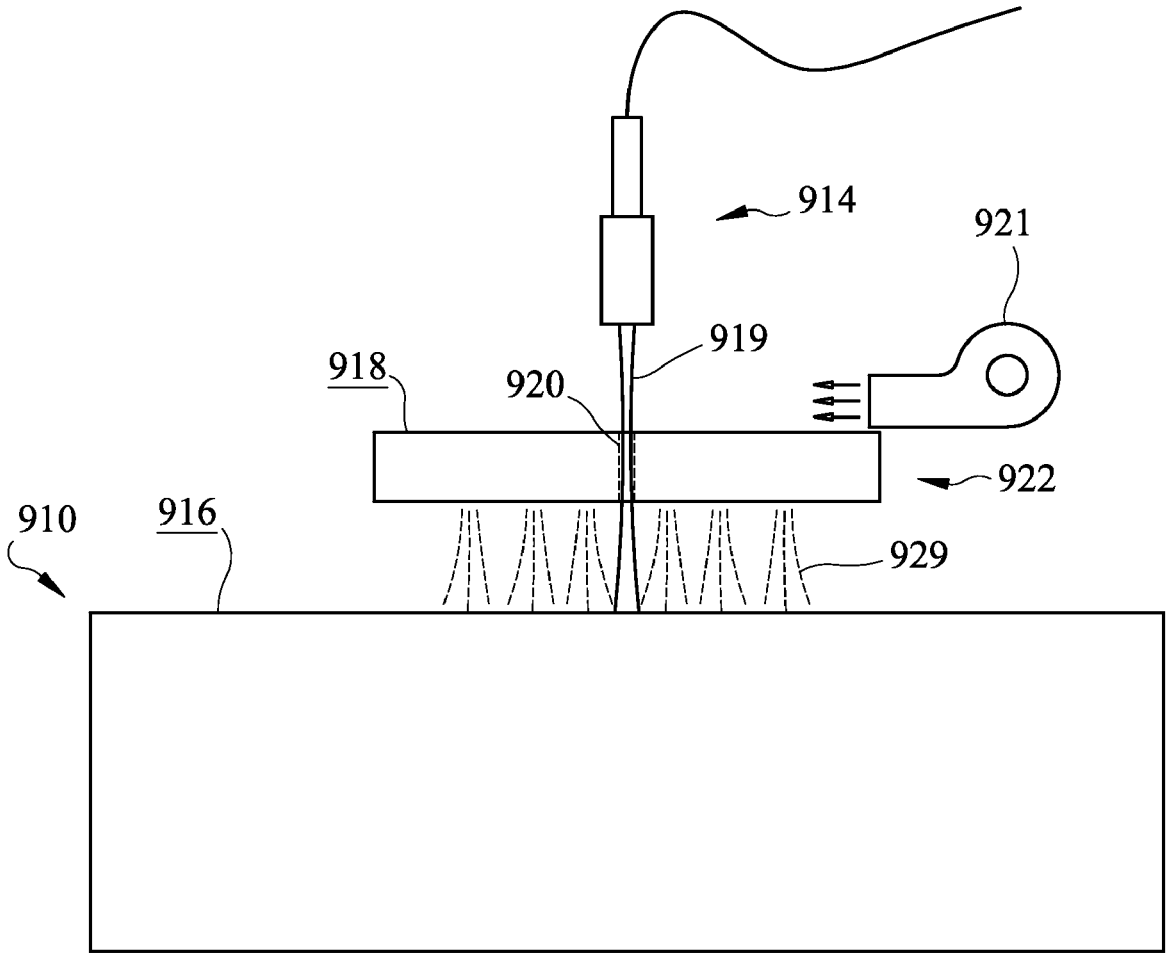
FIG. 19 is a schematic illustration of a forging die temperature sensing system according to one non-limiting embodiment of the present disclosure.

In one non-limiting embodiment, referring to FIG. 19, a system for monitoring the temperature of a forging surface 916 of at least a portion 910 of a forging die is provided. In such a non-limiting embodiment, one or more infra-red thermometers (hereafter "IR thermometers") 914 may be positioned a distance away from a face 918 of the burner head 922 that is not facing the forging surface 916. The one or more IR thermometers 914 may be positioned at a distance of 1 to 12 inches and alternatively 2 to 4 inches, for example, from the face 918 of the burner head 922. One or more apertures 920 may be defined through the burner head 922, such that the IR thermometers 914 may emit a beam 919 to sense various properties of the forging surface 916 through the burner head 922. In one non-limiting embodiment, the apertures 920 may be ¼" holes that are drilled through the burner head 922 using a suitable drill bit, for example. In other non-limiting embodiments, the apertures 920 may have any other suitable sizes. In any event, the apertures 920 may be sufficiently sized to allow IR radiation from the heated forging surface 916 to be sensed from the non-flame side of the burner head 922 for temperature monitoring and temperature control of the forging surface 916. The one or more apertures 920 will not disrupt the flow of water or the mixture of the oxidizing gas and the fuel flowing through the burner head 922, as the apertures 920 may be placed between adjacent flame ports, for example. The IR thermometers 914 may be electrically connected to a logic controller, such as logic controller 804, for example. In one non-limiting embodiment, the IR thermometer 914 may be used in place of the temperature sensor 701 of FIG. 18, for example.

In one non-limiting embodiment, the one or more IR thermometers 914 may need to be jacketed or shielded to protect heat sensitive areas, such as the electronics and the optics (i.e., lens), for example, of the one or more IR thermometers 914 from the high temperature air surrounding the burner head 922 and/or from the heat being radiated by the burner head 922 and/or the forging surface 916. In certain non-limiting embodiments, due to potential thermal degradation of especially the electronics and optics of the one or more IR thermometers 914 caused by exposure to hot gases flowing through the one or more apertures 920, a small blower 921, such as a 75 cubic feet per hour blower, for example, may be used to deflect the hot gases from the one or more IR thermometers 914. The blower 921 may be positioned such that it provides air flow in a direction along or substantially along the face 918, for example, as indicated by the arrows of FIG. 19. Temperature monitoring and temperature control of the forging surface 916 is possible through the use of IR thermometer sensing through flames 929 or by IR thermometer sensing during burner-off cycles between timed flame pulse cycles. Sensing the temperature of the forging surface 916 through the flames 929 may enable real time On-Off set point control, while sensing through flame pulse dwells may provide a more rudimentary On-Off set point control with longer heating cycles than the through the flame sensing technique.

In one non-limiting embodiment, as discussed above, a forging die drift equipment safety-hard stop or spacer can be used to prevent, inhibit, or at least minimize a top portion of a forging die from drifting or being forced downwards into a portion of the forging die heating apparatus and crushing or damaging the portion of the forging die heating apparatus between the top portion and a bottom portion of the forging die during a power outage at a facility. The forging die drift hard-stop or spacer and the forging die heating apparatus can be attached to and/or operably engaged with an automation arm, such as a compressed air automation arm, for example, that can be controlled by an operator using a simple panel of switches, software switches, and/or any other suitable device. The "On" position of the switches can set the forging die in "preheat mode" by bringing the top and bottom portions of the forging die into a preheating, partially closed, or substantially closed position. The forging die heating apparatus and the forging die drift hard-stop or spacer can then be moved into a position at least partially intermediate the top and bottom portions of the forging die and flames in flame ports of a burner head can be ignited using a spark plug, a pilot igniter, a pilot lamp igniter, and/or any other suitable igniting device. The forging die heating apparatus can then be used to preheat the forging die, or regions thereof, and maintain the forging die, or regions thereof, at a predetermined required or desirable temperature or within a predetermined required or desirable temperature range. The "Off" position of the switches can shut off and/or extinguish the flames in the flame ports of the burner head (by eliminating a supply of an oxidizing gas and a supply of a fuel from being provided to the flame ports, for example) and retract the forging die heating apparatus from the position at least partially intermediate the top and bottom portions of the forging die using the automation arm into a position where the forging die heating apparatus is clear of the forging die. The forging die can then be set into the normal "forging" mode. As is apparent to those of ordinary skill in the art, the forging die heating apparatus can also be positioned and removed from a position intermediate the top and bottom portions of the forging die manually, or with other types of automation, for example.

Figure 20:
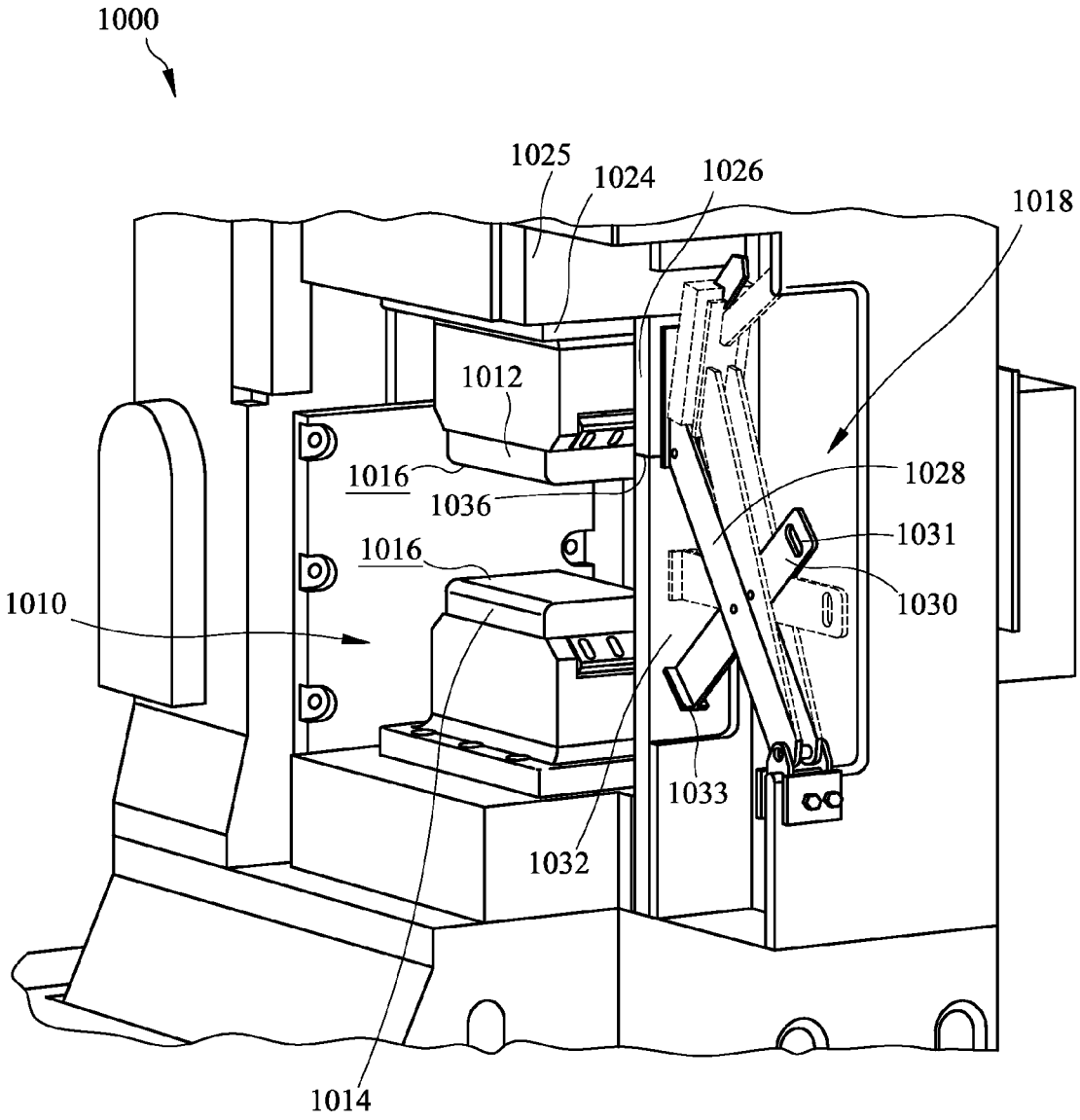
FIG. 20 is a perspective view of a forging die apparatus with a forging die drift hard-stop system according to one non-limiting embodiment of the present disclosure.

In one non-limiting embodiment, referring to FIG. 20, a forging die apparatus 1000 is illustrated. The forging die apparatus 1000 comprises a forging die 1010 including a top portion 1012 and a bottom portion 1014. Each of the top portion 1012 and the bottom portion 1014 include a forging surface 1016 configured to be used to forge a work piece (not illustrated). In one non-limiting embodiment, the top portion 1012 may be attached to or formed with a bolster 1024. The bolster 1024 may be attached to a cross head 1025. The top portion 1012, the bolster 1024, and the cross head 1025 of the forging die 1010 are movable with respect to the fixed bottom portion 1014 of the forging die 1010 such that a work piece can be forged intermediate the movable top portion 1012 and the fixed bottom portion 1014. The forging die apparatus 1000 may also comprise a forging die drift hard-stop system 1018. In one non-limiting embodiment, the forging die drift hard-stop system 1018 can be configured to prevent, or at least inhibit, the top portion 1012 of the forging die 1010 from drifting toward the bottom portion 1014 of the forging die 1010 at an inappropriate time, such as when the forging surfaces 1016 are being preheated, for example.

In one non-limiting embodiment, the forging die drift hard-stop system 1018 may comprise a spacer 1026 attached to a first end of an arm 1028. A second end of the arm may be pivotably attached to a portion of the forging die apparatus 1000, such that the arm 1028 may pivot with respect to the forging die apparatus 1000 to allow movement of the spacer 1026 relative to the forging die apparatus 1000. A lever 1030 may be fixedly or pivotably attached to the arm 1028 at a location intermediate the first end and the second end of the arm 1028. The lever 1030 may comprise a gripping handle 1031 on a first end and an engagement member 1033 on a second end. The lever 1030 and/or the gripping handle 1031 may be used by an operator of the forging die apparatus 1000 to move the spacer 1026 from a first, disengaged position (illustrated in dashed lines) into a second, engaged position (illustrated in solid lines), and then, at an appropriate time, to move the spacer 1026 from the second, engaged position back into the first, disengaged position. When the spacer 1026 is in the first, disengaged position, the engagement portion 1033 of the lever 1030 can contact a plate, a bracket, or a solid portion 1032 of the forging die apparatus 1000 to hold the spacer 1026 in the first, disengaged position where the spacer 1026 will not prevent the top portion 1012 of the forging die 1010 from moving towards the bottom portion 1014 of the forging die 1010. In other various non-limiting embodiments, an actuator (not illustrated) can be operatively engaged with the arm 1028, the lever 1030, and/or the spacer 1026 to, upon activation, accomplish movement of the spacer 1026 between the first, disengaged position and the second, engaged position.

In one non-limiting embodiment, the solid portion 1032 may include an end 1036 configured to receive a portion of the spacer 1026, when the spacer 1026 is in the second, engaged position. Upon movement of the spacer 1026 into the second, engaged position, the spacer 1026 may be at least partially positioned intermediate the solid portion 1032 and a portion of the cross head 1025 to prevent, or at least inhibit, the top portion 1012 of the forging die 1010 from drifting and/or moving toward the bottom portion 1014 of the forging die 1010 at an inappropriate time. The spacer 1026 may be comprised of a material sufficient to withstand the weight and/or force of the bolster 1024, the cross head 1025, and the top portion 1012 of the forging die 1010. In one non-limiting embodiment, although not illustrated, a forging die drift hard-stop system may be provided on more than one side of the forging die apparatus 1000 to maintain a balance of the weight of the cross head 1025, the bolster 1024, and/or the top portion 1012 of the forging die 1010. In yet another non-limiting embodiment, a winch, such as an electrical winch (not illustrated), for example, optionally mounted to the forging die apparatus 1000, may be configured to control the movement of the spacer 1026, the arm 1028, and/or the lever 1030, for example. The electrical winch may comprise a wire or a cable, for example, that is extendible from the winch and retractable toward the winch. The electrical winch may also comprise limit switches configured to control the range of motion of the spacer 1026, the arm 1028, and/or the lever 1030, for example. In one embodiment, the electrical winch may be configured to extend or uncoil the wire or cable to move the spacer 1026 from the first, disengaged position into the second, engaged position. The movement of the spacer 1026 may occur owing to gravitational forces acting upon the spacer 1026. The electrical winch may also be configured to move the spacer 1026 from the second, engaged position into the first, disengaged position by retracting or coiling the wire or cable. In one embodiment, the wire or cable may be attached to the electrical winch at a first end and attached to the arm 1028 at a second end. In such an embodiment, the lever 1030 can be eliminated. In an embodiment where the forging die drift hard-stop system 1018 is positioned on both sides of the forging die apparatus 1000, the spacer 1026, the arm 1028, and/or the lever 1030 of each forging die drift hard-stop system 1018 may be moved simultaneously from the first, disengaged position into the second, engaged position, or vice versa, using a single pair of electrical switches, thereby making the forging die drift hard-stop system 1018 easy to operate.

In one non-limiting embodiment, a method of preheating an open-faced forging die can comprise positioning a burner head comprising at least two flame ports in a location at least partially intermediate a first forging surface of the forging die and a second forging surface of the forging die. In such an embodiment, the burner head can be slid, swung, pivoted, and/or moved into and out of the position at least partially intermediate the first forging surface and the second forging surface, for example. Such sliding, swinging, pivoting, and/or movement can be manual or automated. In one non-limiting embodiment, the forging die heating apparatus can be attached in a transverse, perpendicular, or substantially perpendicular manner to a vertically, or substantially vertically extending support member, such as the wall 384 of FIG. 9, for example. The support member can be positioned proximate to the forging die, such that the forging die heating apparatus can be swung, moved, and/or pivoted about the support member into the position at least partially intermediate the top portion and the bottom portion of the forging die, for example.

In one non-limiting embodiment, an orientation of a burner head can at least partially conform to at least one of an orientation of a first forging surface of a forging die and an orientation of a second forging surface of the forging die. A method for heating a forging die can comprise supplying a fuel to at least two flame ports, combusting the fuel to produce a flame at the least two flame ports, and impinging at least two of the flames onto at least one of the first forging surface and the second forging surface. The method can also comprise positioning a spacer between the first forging surface and the second forging surface to prevent, inhibit, or at least minimize the first forging surface from moving toward the second forging surface when the burner head is positioned at least partially intermediate the first forging surface and the second forging surface. As discussed above, the fuel can comprise an oxy-fuel. The method can further comprise impinging at least two oxy-fuel flames onto at least one of the first forging surface and the second forging surface through the at least two flame ports to uniformly, or substantially uniformly, preheat at least one of the first forging surface and the second forging surface.

Figure 21:
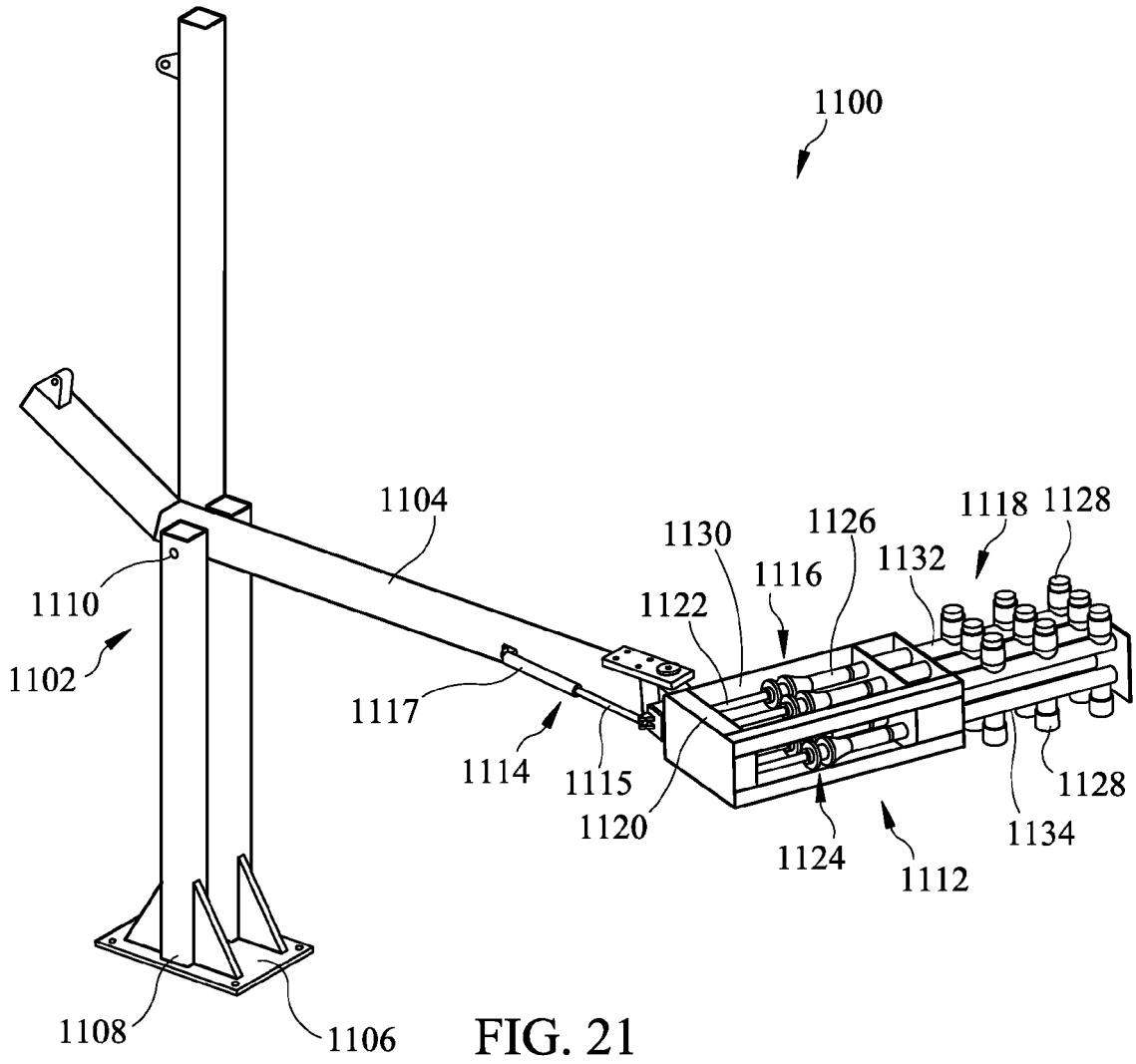
FIG. 21 is a perspective view of a forging die heating apparatus according to one non-limiting embodiment of the present disclosure.

In one non-limiting embodiment, referring to FIG. 21, a burner assembly 1100 may be used to preheat a forging die and/or one or more forging surfaces of the forging die. The burner assembly 1100 may comprise a support member 1102 configured to support an arm 1104. The support member 1102 may comprise a mounting bracket 1106 attached to or formed with an end 1108 thereof. The mounting bracket 1106 may be screwed, bolted, welded, and/or otherwise attached to a surface, such as a horizontal surface, for example. In other non-limiting embodiments, the mounting bracket 1106 may be eliminated and the end 1108 may be attached directly to the surface by welding, for example. In another non-limiting embodiment, the end 1108 may be formed with or attached to a base having a sufficient area such that the burner assembly 1100 may be free standing, for example. In still other non-limiting embodiments, the end 1108 and/or the mounting bracket 1106 may be attached to a surface in any suitable manner known to those of skill in the art. The arm 1104 may be pivotably or rotatably attached to the support member 1102, such that the arm 1104 may be moved about a pivot point 1110 on the support member 1102, for example. In one non-limiting embodiment, the pivot point 1110 may be located proximate to a mid-point of the support member 1102, for example.

Further to the above, in one non-limiting embodiment, the arm 1104 may be moved between a stored position (not illustrated), where a burner head 1112 of the burner assembly 1100 may be positioned adjacent to or proximate to a portion of the support member 1102, and a deployed position, where the burner head 1112 may be positioned most distal from the support member 1102. As referenced above, the arm 1104 may be moved between the stored position and the deployed position by pivoting the arm 1104 about the pivot point 1110.

In one non-limiting embodiment, the burner head 1112 may be attached to or formed with the arm 1104 proximate to an end of the arm 1104 most distal from the pivot point 1110. In other non-limiting embodiments, the burner head 1112 may be attached to or formed with other suitable portions of the arm 1104. Walls of the arm 1104 may define a channel therethrough in a longitudinal direction. The channel may be used to supply a combustible fuel, such as natural gas, for example, to the burner head 1112. The combustible fuel may be supplied to the burner head 1112 at about 30 psi, for example. In one non-limiting embodiment, a tube (not illustrated) may be positioned within the channel such that the combustible fuel may flow from a fuel supply, through the tube, and to the burner head 1112.

In one non-limiting embodiment, still referring to FIG. 21, the burner head 1112 may be movable, rotatable, and/or pivotable relative to the arm 1104. More specifically, the burner head 1112 may be moved from a position where a central longitudinal axis of the burner head 1112 is generally parallel with a central longitudinal axis of the arm 1104, to a position where the central longitudinal axis of the burner head 1112 is angled approximately 90 degrees with respect to the central longitudinal axis of the arm 1104, for example. In other non-limiting embodiments, the central longitudinal axis of the burner head 1112 may be angled between 0 and 120 degrees with respect to the central longitudinal axis of the arm 1104, for example. This movement of the burner head 1112 may be manual or automated. The burner head 1112 may be moved relative to the arm 1104 such that it may be positioned intermediate a forging surface of a top forging die and a forging surface of a bottom forging die, for example. In one non-limiting embodiment, the burner head 1112 may be moved relative to the arm 1104 using an actuator 1114, such as a compressed air piston-type actuator or a hydraulic piston-type actuator, for example. A first portion of the actuator 1114 may be attached to the arm 1104 and a second portion of the actuator 1114 may be attached to the burner head 1112, such that as a piston 1115 of the actuator 1114 is moved into and out of a housing 1117 of the actuator 1114, the burner head 1112 may be moved relative to the arm 1104. In other non-limiting embodiments, any other suitable actuator may be used to move the burner head 1112 relative to the arm 1104. In one non-limiting embodiment, the burner head 1112 can move in any suitable direction relative to the arm 1104, such that the burner head 1112 can be suitably positioned relative to a forging surface of a forging die.

In one non-limiting embodiment, the burner head 1112 may comprise a housing portion 1116 and a burner head portion 1118. The housing portion 1116 may comprise a manifold 1120 configured to receive the combustible fuel from the channel, or the tube within the channel, of the arm 1104. The manifold 1120 may be in fluid communication with a plurality of conduits 1122 used to flow the combustible fuel to one or more assemblies 1124. In one non-limiting embodiment, the manifold 1120 may be in fluid communication with six conduits 1122 used to flow the combustible fuel to six assemblies 1124, for example. The assemblies 1124 may each comprise an orifice configured to allow a predetermined amount of the combustible fuel to flow therethrough. The orifices may have a diameter in the range of about 30 mils to about 100 mils, for example. The orifices may regulate and/or restrict the flow of the combustible fuel through the assemblies 1124 to provide a suitable amount of the combustible fuel to the burner head portion 1118. In one non-limiting embodiment, the assemblies 1124 may also comprise an air aspirator configured to allow ambient air to bleed or flow into the assemblies 1124. The air aspirator may at least partially surround the assemblies 1124, for example, such that the ambient air may flow or bleed into the assemblies 1124 from any suitable direction. As a result of the air aspirator, the combustible fuel may be mixed with the ambient air (i.e., oxidizing gas) within a plurality of tubes 1126. The plurality of tubes 1126 may be in fluid communication with at least one burner nozzle 1128 positioned on the burner head portion 1118. In one non-limiting embodiment, the plurality of tubes 1126 may be in fluid communication with three or more burner nozzles 1128 within the burner head portion 1118, for example. The housing portion 1116 may comprise a shell 1130 that may at least partially surround the conduits 1122, the assemblies 1124, and/or the tubes 1126 to protect the conduits 1122, the assemblies 1124, and/or the tubes 1126 from being smashed or damaged during use of or storage of the burner head 1112 and/or to provide a heat shield for the conduits 1122, the assemblies 1124, and/or the tubes 1126, for example.

Further to the above, still referring to FIG. 21, the burner head portion 1118 may comprise the one or more burner nozzles 1128. In certain non-limiting embodiments, a first plurality of the burner nozzles 1128 may be situated on a first side 1132 of the burner head portion 1118 and second plurality of the burner nozzles 1128 may be situated on a second side 1134 of the burner head portion 1118. In one non-limiting embodiment, nine of the burner nozzles 1128 may be positioned on the first side 1132 of the burner head portion 1118 and nine of the burner nozzles 1128 may be positioned on the second side 1134 of the burner head portion 1118. The various burner nozzles 1128 may be in fluid communication with the tubes 1126 such that the burner nozzles 1128 may receive and combust the mixture of the combustible fuel and the air. In one non-limiting exemplary embodiment, three burner nozzles 1128 may be in fluid communication with one tube 1126 via openings or orifices in the tube 1126 at a location proximate to each burner nozzle 1128, for example. The various burner nozzles 1128 may comprise an igniter configured to ignite the mixture of the combustible fuel and the air, such that the burner nozzles 1128 may produce a flame.

In operation, the burner assembly 1100 may be positioned or mounted proximate to a forging die. The arm 1104 may be moved or pivoted from the stored position into the deployed position. The actuator 1114 may then be activated to move the burner head 1112 from a position where the central longitudinal axis of the burner head 1112 is generally parallel with the central longitudinal axis of the arm 1104 to a position where the burner head 1112 is at about a 90 degree angle with respect to the central longitudinal axis of the arm 1104. As the burner head 1112 is moved into the about 90 degree position, it may also be moved into a position at least partially intermediate a top forging surface and a bottom forging surface of a forging die, for example. In one non-limiting embodiment, the burner nozzles 1128 on the first side 1132 of the burner head portion 1118 may be positioned between four and eight inches away from the top forging surface and, likewise, the burner nozzles 1128 on the second side 1134 of the burner head portion 1118 may be positioned between about four and about eight inches away from the bottom forging surface. In other non-limiting embodiments, the burner nozzles 1128 on the first side 1132 and the second side 1134 may each be positioned about six inches away from the top and bottom forging surfaces of the forging die, for example.

In one non-limiting embodiment, one or more of the burner nozzles 1128 on the first side 1132 and/or the second side 1134 may extend a different distance from the first side 1132 and/or the second side 1134 than other burner nozzles 1128 positioned on the first side 1132 and/or the second side 1134 in order to heat a forging surface of a vee die or another forging die, for example. In other non-limiting embodiments, the burner nozzles 1128 may also be situated a various angles relative to the first side 1132 and/or the second side 1134, again such that the burner head 1112 may be configured to heat a vee die or another forging die, for example. In one exemplary non-limiting embodiment, three rows of three burner nozzles 1128 per row may be provided on the first side 1132 and the second side 1134 of the burner head portion 1118. A first row of the burner nozzles 1128 and a third row of the burner nozzles 1128 may extend a first distance from the first side 1132 and/or the second side 1134 and a second row of the burner nozzles 1128 may extend a second distance from the first side 1132 and/or the second side 1134. The first distance may be larger than or smaller than the second distance such that the burner head 1112 may be configured for use with forging die surfaces having various configurations, orientations and/or shapes. In other non-limiting embodiments, the burner nozzles 1128 within each row may extend a different distance from the first side 1132 and/or the second side 1134 and/or may extend at different angles relative to the first side 1132 and/or the second side 1134, for example. Those of skill in the art, upon consideration of the present disclosure, will recognize that the various burner nozzles 1128 may have any suitable configuration or orientation for appropriately heating variously shaped forging surfaces or forging dies.

The burner assembly 1100 may be used to preheat or heat a forging die and/or one or more forging surfaces of the forging die from room temperature to about 1000 degrees Fahrenheit in approximately 30 to 45 minutes, for example. Of course, other heating rates may also be achieved by varying the amount of the combustible fuel or the air provided to the burner head 1112 by adjusting the sizes of the orifices and/or the air aspirators of the assemblies 1124, by varying the number of burner nozzles 1128 provided on the burner head 1112, and/or by varying the configuration and/or orientation of the burner nozzles 1128 on the first and second sides 1132 and 1134 of the burner head 1112, for example. While the burner assembly 1100 has been described as using a combustible fuel, such as natural gas, those of skill in the art will recognize that other suitable combustible fuels may be used with the burner assembly 1100.

It will be recognized by those of skill in the art that features or components of particular non-limiting embodiments described herein can be used in conjunction with other non-limiting embodiments described herein and/or with other non-limiting embodiments within the scope of the claims.

Although the foregoing description has necessarily presented only a limited number of embodiments, those of ordinary skill in the relevant art will appreciate that various changes in the apparatuses and methods and other details of the examples that have been described and illustrated herein may be made by those skilled in the art, and all such modifications will remain within the principle and scope of the present disclosure as expressed herein and in the appended claims. For example, although the present disclosure has necessarily only presented a limited number of non-limiting embodiments of forging die heating apparatuses, and also has necessarily only discussed a limited number of non-limiting forging die heating methods, it will be understood that the present disclosure and associated claims are not so limited. Those having ordinary skill will readily identify additional forging die heating apparatuses and methods and may design and build and use additional forging die heating apparatuses and methods along the lines and within the spirit of the necessarily limited number of embodiments discussed herein. It is understood, therefore, that the present invention is not limited to the particular embodiments or methods disclosed or incorporated herein, but is intended to cover modifications that are within the principle and scope of the invention, as defined by the claims. It will also be appreciated by those skilled in the art that changes could be made to the non-limiting embodiments and methods discussed herein without departing from the broad inventive concept thereof.

What is claimed is:

1. A forging die heating apparatus, comprising:

a burner head comprising a plurality of flame ports configured to impinge flames onto one or more forging surface regions of at least one forging surface of a forging die;

the burner head configured to receive and combust a supply of an oxidizing gas and a supply of a fuel and produce flames at the flame ports, wherein the burner head comprises a first portion comprising one or more first flame ports and a second portion comprising one or more second flame ports, and wherein the first portion is movable relative to the second portion to move at least one first flame port relative to at least one second flame port to at least partially conform an orientation of at least one first flame port to an orientation of a first forging surface region of the forging die.

2. The forging die heating apparatus of claim 1, wherein the second portion is configured to move relative to a second forging surface region of the forging die to at least partially conform an orientation of at least one second flame port to an orientation of the second forging surface region.

3. The forging die heating apparatus of claim 2, wherein the burner head further comprises: a third portion comprising one or more flame ports, wherein the third portion is movable relative to at least one of the first portion and the second portion to at least partially conform an orientation of at least one flame port of the third portion to an orientation of a third forging surface region of the forging die.

4. The forging die heating apparatus of claim 1, comprising:

a movable member positioned intermediate the first portion and the second portion, wherein the first portion is configured to move relative to the second portion about the moveable member to at least partially conform an orientation of at least one first flame port to the orientation of the first forging surface region.

5. The forging die heating apparatus of claim 1, comprising:

an actuator operably engaged with the first portion, wherein the actuator is configured to move the first portion relative to one of the first forging surface region and the second portion to at least partially conform an orientation of at least one first flame port to the orientation of the first forging surface region.

6. The forging die heating apparatus of claim 1, comprising:

a mixing device configured to mix the supply of the oxidizing gas with the supply of the fuel to provide a mixed supply; and a manifold in fluid communication with the mixing device and the first and second flame ports, wherein the manifold is configured to provide the mixed supply to the first and second flame ports which combust the mixed supply and impinge flames onto one or more forging surface regions of the forging die.

7. The forging die heating apparatus of claim 4, comprising an actuator operatively engaged with the first portion, wherein the actuator is configured to move the first portion about the movable member.

8. The forging die heating apparatus of claim 1, comprising:

a mixing device in fluid communication with the burner head, wherein the mixing device is configured to mix the supply of the oxidizing gas with the supply of the fuel to create a mixed supply;

wherein the first portion comprises a first side of the burner head and the second portion comprises a second side of the burner head, wherein the first portion comprises a first set of flame ports comprising at least two flame ports and the second portion comprises a second set of flame ports comprising at least two flame ports, wherein the first set of flame ports and the second set of flame ports are configured to receive and combust the mixed supply to produce flames at the first set of flame ports and the second set of flame ports;

the first set of flame ports configured to impinge at least two flames onto a first forging surface of the forging die; and the second set of flame ports configured to impinge at least two flames onto a second forging surface of the forging die.

9. The forging die heating apparatus of claim 1, wherein the forging die comprises a first forging surface and a second forging surface, and wherein the first forging surface and the second forging surface are configured to move relative to each other, the forging die heating apparatus comprising:

a spacer configured to be positioned at least partially intermediate the first forging surface and the second forging surface to at least inhibit the first forging surface from moving toward the second forging surface when the burner head is disposed at least partially intermediate the first forging surface and the second forging surface.

10. The forging die heating apparatus of claim 1, wherein the oxidizing gas is substantially comprised of oxygen and the burner head is configured to receive and combust an oxy-fuel and produce flames at the flame ports.

11. The forging die heating apparatus of claim 1, wherein the plurality of flame ports are spaced apart a substantially identical distance relative to one another on at least a region of a surface of the burner head.

12. The forging die heating apparatus of claim 1, wherein each of the plurality of flame ports is configured to provide a flame of a substantially uniform size.

13. A method of heating a forging die, the method comprising:

positioning a burner head in proximity to one or more forging surface regions of at least one forging surface of the forging die, wherein the burner head comprises a first portion comprising one or more flame ports and a second portion comprising one or more flame ports;

moving at least one of the first portion and the second portion relative to the other to at least partially conform an orientation of at least one of the flame ports to an orientation of at least one forging surface region of the forging die;

supplying a fuel to the first and second portions;

combusting the fuel at the one or more first and second flame ports to produce a flame at each of the flame ports; and impinging the flames onto the one or more forging surface regions of the forging die and substantially uniformly heating the one or more forging surface regions of the forging die.

14. The method of claim 13, wherein the method further comprises pivoting the first portion relative to the second portion to at least partially conform an orientation of at least one first flame port to an orientation of a first forging surface region of the forging die.

15. The method of claim 13, wherein the method further comprises operating an actuator operably engaged with the burner head to move the burner head from a first configuration to a second configuration to at least partially conform an orientation of at least one first flame port to an orientation of at least one forging surface region of the forging die.

16. The method of claim 13, wherein the forging die comprises a first forging surface and a second forging surface, and wherein the method further comprises:

supplying an oxy-fuel to the burner head and combusting the oxy-fuel at at least two flame ports to produce an oxy-fuel flame at the at flame ports; and positioning the burner head intermediate the first forging surface and the second forging surface and impinging the at least two oxy-fuel flames on at least a first forging surface region of the first forging surface and at least a second forging surface region of the second forging surface.

17. The method of claim 13, further comprising:

positioning the burner head a distance of 0.5 inches to 8 inches from the one or more forging surface regions prior to impinging the flames onto the one or more forging surfaces regions, wherein a surface of the burner head comprising the flame ports is positioned substantially parallel to a plane of at least one of the one or more forging surface regions.

18. The method of claim 13, further comprising:

monitoring a temperature of the forging die; and intermittently impinging, based on the monitoring, the flames onto the one or more forging surface regions of the forging surface to adjust the temperature of the forging surface to at least a minimum desired temperature.

* * * * *